US010397678B2

(12) United States Patent
Rodrigues

(10) Patent No.: US 10,397,678 B2
(45) Date of Patent: Aug. 27, 2019

(54) VERSATILE MOUNTING SYSTEM

(71) Applicant: Fernando Tude Rodrigues, Recife (BR)

(72) Inventor: Fernando Tude Rodrigues, Recife (BR)

( * ) Notice: Subject to any disclaimer, the term of this patent is extended or adjusted under 35 U.S.C. 154(b) by 198 days.

(21) Appl. No.: 15/500,942

(22) PCT Filed: Aug. 28, 2015

(86) PCT No.: PCT/US2015/047582
§ 371 (c)(1),
(2) Date: Feb. 1, 2017

(87) PCT Pub. No.: WO2016/033552
PCT Pub. Date: Mar. 3, 2016

(65) Prior Publication Data

US 2017/0223440 A1 Aug. 3, 2017

Related U.S. Application Data

(60) Provisional application No. 62/043,350, filed on Aug. 28, 2014.

(51) Int. Cl.

| | |
|---|---|
| ***H04R 1/02*** | (2006.01) |
| ***H04R 3/12*** | (2006.01) |
| ***H04R 1/32*** | (2006.01) |
| ***H04R 3/00*** | (2006.01) |
| *H04R 5/02* | (2006.01) |

(52) U.S. Cl.
CPC ..... *H04R 1/026* (2013.01); *H04R 1/323* (2013.01); *H04R 3/00* (2013.01); *H04R 3/12* (2013.01); *H04R 1/025* (2013.01); *H04R 5/02* (2013.01); *H04R 2201/021* (2013.01); *H04R 2201/023* (2013.01); *H04R 2201/025* (2013.01); *H04R 2420/09* (2013.01); *H04R 2499/13* (2013.01)

(58) Field of Classification Search
CPC ..... H04R 1/026; H04R 1/323; H04R 3/00; H04R 3/12; H04R 2201/021; H04R 2499/13; H04R 2420/09; H04R 2201/025; H04R 2201/023; H04R 1/025; H04R 5/02
See application file for complete search history.

(56) References Cited

U.S. PATENT DOCUMENTS

| | | | | |
|---|---|---|---|---|
| 7,699,377 | B2 * | 4/2010 | Vitito | B60K 35/00 248/917 |
| 8,900,009 | B2 * | 12/2014 | Hornick | H01R 13/73 248/288.51 |
| 8,926,336 | B2 * | 1/2015 | Gobel | H01R 24/542 439/13 |
| 9,531,118 | B2 * | 12/2016 | Byrne | H01R 13/2421 |
| 9,729,791 | B2 * | 8/2017 | Huerta | H04N 5/23241 |
| 9,880,962 | B2 * | 1/2018 | Tuccinardi | G06F 13/4081 |

(Continued)

*Primary Examiner* — Oyesola C Ojo

(57) ABSTRACT

Interfaces that can supply power and/or data, for example audio or video data, are described that can be joined to form a rotatable coupling, along with electronic devices that incorporate such couplings. Such devices can be joined by such couplings to provide portable and easily customizable systems, where individual system components can be rotated relative to each other and can be easily interchanged with alternative components by a user at their discretion. Such systems can be installed in or on automobiles, homes, offices, wearable items, and chairs.

13 Claims, 21 Drawing Sheets

(56) References Cited

U.S. PATENT DOCUMENTS

| | | | | |
|---|---|---|---|---|
| 2009/0154722 | A1* | 6/2009 | De Jong | H04R 5/02 381/77 |
| 2009/0227122 | A1* | 9/2009 | Jubelirer | H01R 31/065 439/11 |
| 2010/0051310 | A1* | 3/2010 | Wurzer | H02G 3/0493 174/59 |
| 2013/0068915 | A1* | 3/2013 | Yang | F16M 11/041 248/551 |

* cited by examiner

VERSATILE MOUNTING SYSTEM

This application claims the benefit of U.S. Provisional Patent Application No. 62/043,350, filed Aug. 28, 2014. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is mounting systems for electronic equipment and/or small appliances.

BACKGROUND

Modern consumers are constantly seeking solutions for their needs that are more versatile that former offerings while also being more efficient. These characteristics can be provided by providing products that small in size, light weight, portable, and that provide a degree of versatility or customizability to the end user. Fixed, non-portable solutions, on the other, are increasingly becoming obsolete and undesirable.

This is particularly true in regards to consumer electronics, for example systems that deliver audio and/or video. In addition, there is a growing interest in the ability to incorporate or integrate non-traditional components, for example smart telephones or tablet computers, into such systems in order to provide a user with a more unified interface. Such systems are further expected to perform substantially the same independent of location and to deliver performance similar to that of traditional fixed systems, while at the same time supporting customization.

An example of this in the field of audio systems can be found in automobile stereos and/or infotainment systems. Such systems are generally provided as systems that are fixed to or integrated into the vehicle. The number of speakers and their orientation, frequency range, and wattage are fixed at the time the automobile is manufactured. In this way they are not versatile and significantly limit the experience of the consumer. The limited power and often questionable quality of such conventional automobile audio systems has led to a well established market or custom audio components for automobiles, however these are generally designed to merely replace specific components of the existing system, with extensive modification of the vehicle itself being required to substantially alter an audio systems performance characteristics. Even so, once such alterations are made the end result is another fixed configuration.

One solution is to utilize auxiliary audio systems components that can be worn by the user, for example earbuds or headphones. These are not suitable for all applications, however, as they block environmental noises and fail to accurately reproduce a full range of audio frequencies. In particular, current headphones and earbuds frequently fail to reproduce low audible frequencies well. In addition, such auxiliary components do not reproduce low frequency, inaudible or nearly inaudible sound that is responsible for the visceral "feel" of a live musical performance. It should also be appreciated that such devices, which are in intimate physically contact with the user, are perceived by many users as irritating over time.

Another solution is to provide one or more external speakers or speaker assemblies. These have been proposed for, for example, for use in automobiles and on automobile headrests. For example, U.S. Pat. No. 4,638,884 (to Lee) discloses an automobile headrest that incorporates a pair of speakers, positioned on either side of the headrest and angled slightly forward. All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Similarly, U.S. Pat. No. 3,944,020 (to Brown) and U.S. Pat. No. 4,490,842 (to Watanabe) disclose automobile headrests that incorporate a pair of speakers joined to resonating chambers, in order to improve performance at certain audio frequencies. Such designs, however, do not permit adjustment of the position of the speakers and are not amenable to customization. U.S. Pat. No. 4,042,791 (to Wiseman) discloses a more sophisticated design where each headrest speaker is mounted on a hinge that permits angular adjustment within a limited range in a single plane. Similarly, Great Britain Patent Application No. 2,224,178A discloses a pair of speakers that are secured to an automobile headrest by an elastic band, in which each speaker is mounted in a hinged assembly that permits limited angular adjustment in a single plane. Such designs, however, at best offer only very limited speaker positioning and arrangement options to a user, and are not suitable for securing and arranging other commonly used devices (for example, a smart phone).

Thus, there is still a need for devices and methods that allow a user to easily customize the configuration and/or performance of audio and/or video systems, particularly portable systems.

SUMMARY OF THE INVENTION

The inventive subject matter provides apparatus, systems and methods in which a coupling is provided that includes a first interface and a second interface, which engage each other to form a rotatable coupling. The first and second interfaces can rotate relative to one another, and are configured to support the supplying of power and/or data (for example audio and/or video data) across the coupling during rotation. Such data communication can be accomplished through a wired or a wireless connection. Such couplings can be used to provide mechanical support and communication between a wide variety of devices, for example between a receiver/amplifier and a speaker or between two speakers. An electronic device can include more than one interface in order to support provision of a chain of three or more coupled devices. In some embodiments the first and second interfaces can be selected to provide both power and data across a coupling. In other embodiments the first and second interfaces can be selected to provide only power across a coupling, or, alternatively, only data. In still other embodiments of the inventive concept the first and second interfaces are selected so that no power or data is provided across the coupling, which in such embodiments can act as a mechanical mount. Components that can be fitted with such interfaces include audio transducer/speakers, cameras, lights, fans, mounts for cell phones or other personal electronic devices, and supports (such as shelves or cup holders).

Other embodiments of the inventive concept include devices, for example electronic devices, that incorporate such interfaces. Such devices can be combined to form systems, which are readily configurable by a user by adjusting the rotational angle of a system component mounted using a rotatable coupling, movement of a system component between various interfaces of the system, and/or replacement of a component with a different component having different performance or functionality. Such systems can utilize wired connections, wireless connections, or a combination of wired and wireless connections for data communication.

A variety of specific implementations are considered, including mounting of various devices to automobile headrests, portable systems suitable for use in automobiles, systems configured for home or office use, portable systems that can be worn or carried by a user (for example in a backpack or mounted to a frame that can be carried), and systems that are configured to be mounted to a seating surface (such as a chair, lounge, loveseat, or couch).

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 2A shows a pair of interfaces that are secured to each other to form a connector using tabs. FIG. 2B shows an alternative, low aspect ratio embodiment of an interface and its use in a connector.

FIG. 6A shows a lamp that can be joined to a device carrying an interface of the inventive concept. FIG. 6B shows a camera that can be joined to a device carrying an interface of the inventive concept.

FIG. 7A shows an interface affixed to an elastic band. FIG. 7B shows an interface affixed to an elastic or inelastic band that includes a mechanism for adjusting the length of the band.

FIG. 8A shows a lamp that can be joined to a device carrying an interface of the inventive concept. FIG. 8B shows a camera that can be joined to a device carrying an interface of the inventive concept.

FIG. 9A shows a partially exploded view of a speaker pair attached to an automobile headrest by a rotatable coupling of the inventive concept. FIG. 9B shows a partially exploded view of a lamp attached to an automobile headrest by a rotatable coupling of the inventive concept.

FIG. 9C shows a partially exploded view of a fan attached to an automobile headrest by a rotatable coupling of the inventive concept. FIG. 9D shows a partially exploded view of a cell phone holder attached to an automobile headrest by a rotatable coupling of the inventive concept, along with a cell phone.

FIG. 11A shows a speaker with a single interface. FIG. 11B shows an example of a speaker having two interfaces on different sides of the speaker. FIG. 11C shows a speaker as in FIG. 11B two which a secondary speaker is being added by mating to one of the interfaces to form a rotatable coupling. FIG. 11D. shows a speaker system in which three speakers are joined by rotatable couplings formed by mating interfaces of the inventive concept.

FIG. 12A shows an external view of such a speaker. FIG. 12B shows an external view of a similar speaker that includes an additional interface. A removable tray that mounts to the upper surface of the portable speaker is also shown. FIG. 12C shows a cross section of the speaker of FIG. 12B and a removable tray.

FIG. 14A shows a mounting device that includes a band and terminal grasping structures that support interfaces of the inventive concept. FIG. 14B depicts a mounting device as shown in FIG. 14A engaged with a pillar. A speaker carrying a complementary interface and in position be mounted to the pillar by mating of the interfaces to form a rotatable coupling is also shown, as is an optional reinforcing band.

FIG. 15A depicts a partial cross section view of a backpack embodiment, showing a low frequency speaker orientated towards the wearer's trunk or torso and interfaces of the inventive concept proximal to the wearer's ears. FIG. 15B shows an embodiment similar to that of FIG. 15A with a pair of small, high frequency speakers mated to the backpack. FIG. 15C shows a side, partially exploded view of a wearable embodiment. FIG. 15D shows a top down view of a wearable embodiment.

FIG. 16A depicts an external view of a backpack embodiment, showing a base that includes interfaces of the inventive concept proximal to the wearer's ears. FIG. 16B shows an exploded view illustrating an order of assembly for various components. FIG. 16C shows a side view of a user wearing a wearable embodiment. FIG. 15D shows a top down view of a user wearing wearable embodiment.

FIG. 17A shows a side view of such a system mounted to an office chair, an its position relative to a seated user. FIG. 17B shows a rear view of such a system mounted to an office chair, an its position relative to a seated user.

DETAILED DESCRIPTION

Figure 1:
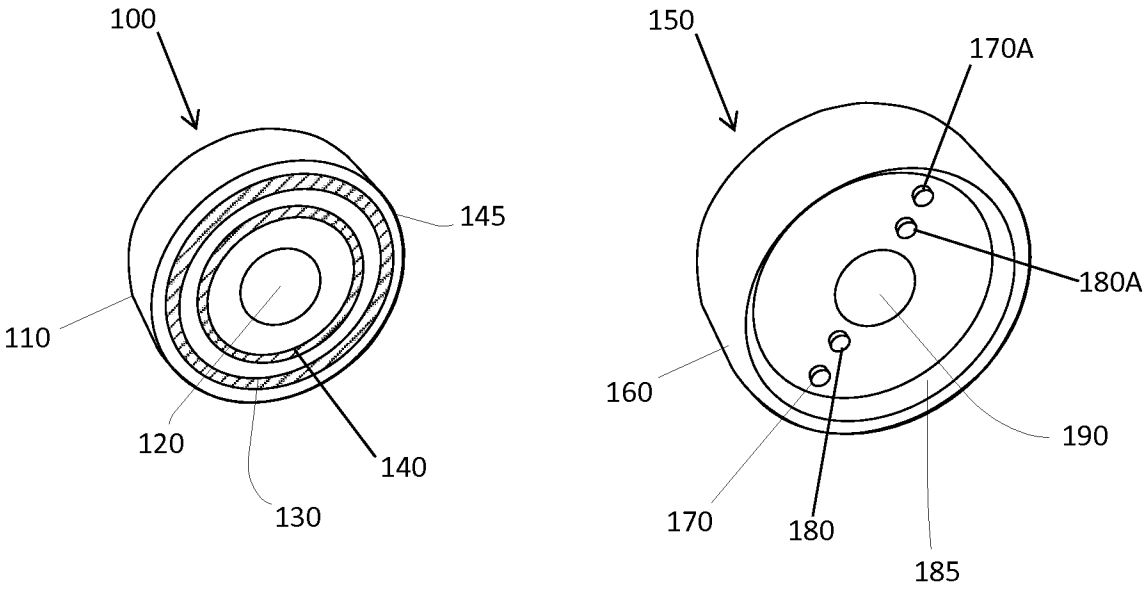
FIG. 1 shows a pair of interfaces of the inventive concept which, when mated, form a connector.

The following description includes information that may be useful in understanding the present invention. It is not an admission that any of the information provided herein is prior art or relevant to the presently claimed invention, or that any publication specifically or implicitly referenced is prior art.

The inventive subject matter provides apparatus, systems and methods in which an electronic device (for example an audio transducers) can be provided as a portable system suitable for interfacing with another electronic device (for example, an amplifier of an audio system), such that the electronic device can be rotated through at least 180° while maintaining connections to power and/or a data stream (for example, audio data). This connection is provided by a coupling, which is formed by engaging a first interface on one device with a second interface on another device. Such interfaces are configured to support transmission of power and/or data (for example, video and/or audio data) across the coupling when the interfaces are engaged, to rotate relative to one another while remaining engaged and maintaining power and/or data transmission, and to provide mechanical support between the devices (i.e. provide sufficient support to maintain the relative positions of devices so coupled during normal use). In some embodiments, only power is provided across the coupling. In other embodiments only data (for example, audio and/or video data) is provided across the coupling. In still other embodiments the coupling can act as a mechanical mount, for example for use with non-powered or independently powered devices. Such various coupling configurations can be provided by selection of features of the corresponding interfaces.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

One should appreciate that the devices, systems, and methods provide a user with the ability to quickly and easily customize the performance characteristics and/or configuration of an audio and/or video system, in particular when such a system is portable.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

One embodiment of the inventive concept is a portable audio system. Such a portable audio system can, for example, be configured for use in an automobile, but can also be configured for use with a home audio system or other audio system designed for use in a stationary structure. Such a portable audio system can include a base unit, which receives an audio signal (for example, digital or analog audio data) from an audio system, for example via an audio data interface, and that includes a power interface for receiving electrical power (for example, from an automobile power system or from municipal power). The base unit provides an output, which can include a power component and/or an audio data component. The base unit can have any dimension suitable for its purpose. For example, a base unit intended for use with headrest-mounted speakers can be dimensioned to fit beneath a seat of a motor vehicle. Alternatively, a base unit intended for home use can be dimensioned for positioning within an entertainment system.

The portable audio system can also include a first interface that provides communication between a power output of the base unit and a power connector of the first interface and also provides communication between an audio data output of the base unit and an audio data connector of the first interface. An audio transducer (for example a speaker) can be provided that includes a second interface that engages or mates with the first interface to form a coupling, where the second interface includes a power connector that connects with the power connector of the first interface and an audio connector that connects with the audio connector of the first interface when the first and second interfaces are engaged. The first interface and second interface are configured such that their respective power and audio connections remain connected as the second interface is rotated relative to the first interface An example of such a connector (in this instance showing a single connection pair) is shown in FIG. 1. As shown, a first interface 100 can include a body 110 and a pair of concentrically arranged circular contacts 130, 140 with different radii, which can provide power and/or data communication. It should be appreciated that there are a variety of suitable contact configurations that can provide this function, and that such contacts can be continuous or discontinuous and generally radially arranged in order to permit rotation of the coupling. The first interface 100 can also include features that help to secure the first interface 100 to a second interface 150 to form a coupling. Such a securing feature can include a magnetic or magnetically response material 120 and/or a surface contact 145. A second interface 150 can include a body 160 and projecting contacts 170, 180 positions to provide communication with the circular contacts 130, 140 of the first interface 100 when assembled as a coupling. In some embodiments, additional projecting contacts (for example 170A, 180A) can be provided to insure transmission. Suitable projecting contacts includes posts, pins, and tabs, and can be pliant and/or spring loaded in order to provide good communication without damaging the corresponding circular contact when the coupling is assembled. A second interface 150 can also include securing features that complement those of the first interface 100, such as complementary magnetic or magnetically responsive material 190 and/or a complementary contact surface 185. Such contact interfaces can maintain and/or stabilize a rotatable mechanical connection between the first and second interfaces when assembled as a coupling, for example by friction, by engagement of complementary tabs, or by insertion of a projection into a complementary groove. While a single pair of contacts is shown in FIG. 1, it should be appreciated that the number and arrangement of circular and projecting contacts can be adjusted to provide both power and data communication across a rotatable coupling, power communication only, data communication only, and multiple power and/or data connections.

It should be appreciated that this arrangement can be reversed, and that other arrangements (for example, pairs of discontinuous circular contacts arranged so that electrical or data communication is not interrupted during rotation) are also suitable. It is contemplated that additional power contacts and audio contacts, similarly arranged to support radial movement without interfering with one another, can be included. In some embodiments the first interface and the second interface can be rotated through at least 180° relative to one another while maintaining electrical and/or data contact across the interfaces. In other embodiments, the first interface and the second interface can be rotated through at least 360° relative to one another while maintaining electrical and/or audio contact across the interfaces.

A first interface can include features that facilitate forming a connection with a second interface that permits rotation of the interfaces relative to one another. For example, a first interface can include one or more projections (for example, a collar or a set of tabs) that extends outward from the periphery of the first interface, and which is dimensioned to mate with a corresponding peripheral indentation of the second interface, forming a friction fit that retains the connection between the interfaces while permitting rotation. Alternatively, a first interface can include a central shaft which extends through an aperture of the second interface, and can be secured either within the connection or exterior to the second interface. In yet another embodiment a first interface can include a peripheral channel that retains one or more anchor points, which can move within the channel. In such an embodiment a second interface can include projections that extend to and can be secured (for example, via snaps, buckles, or hook and loop closures) to such anchor points.

Figure 2A:
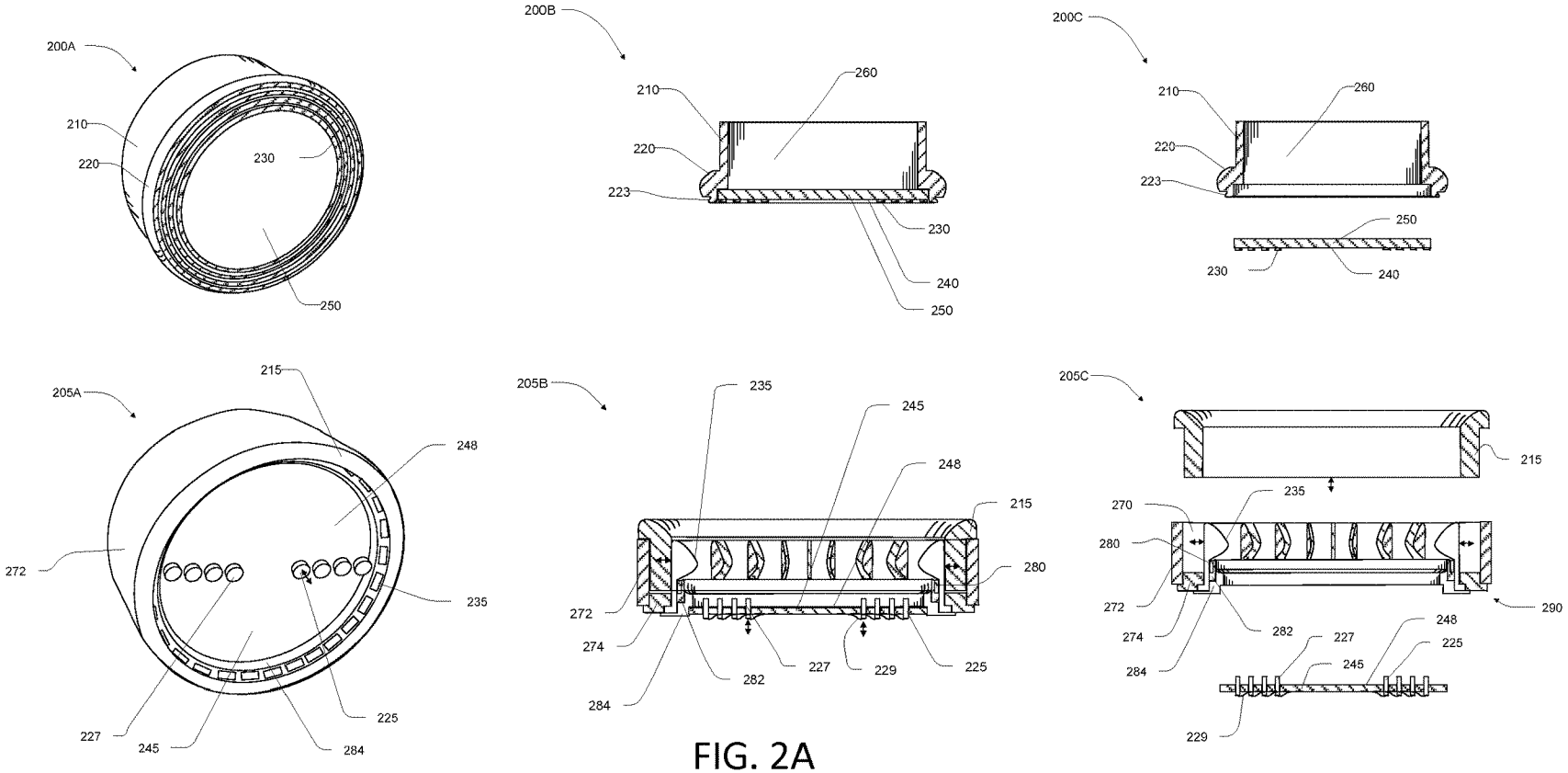
FIGS. 2A and 2B show an alternative embodiment of a pair of interfaces of the inventive concept.
Figure 3:
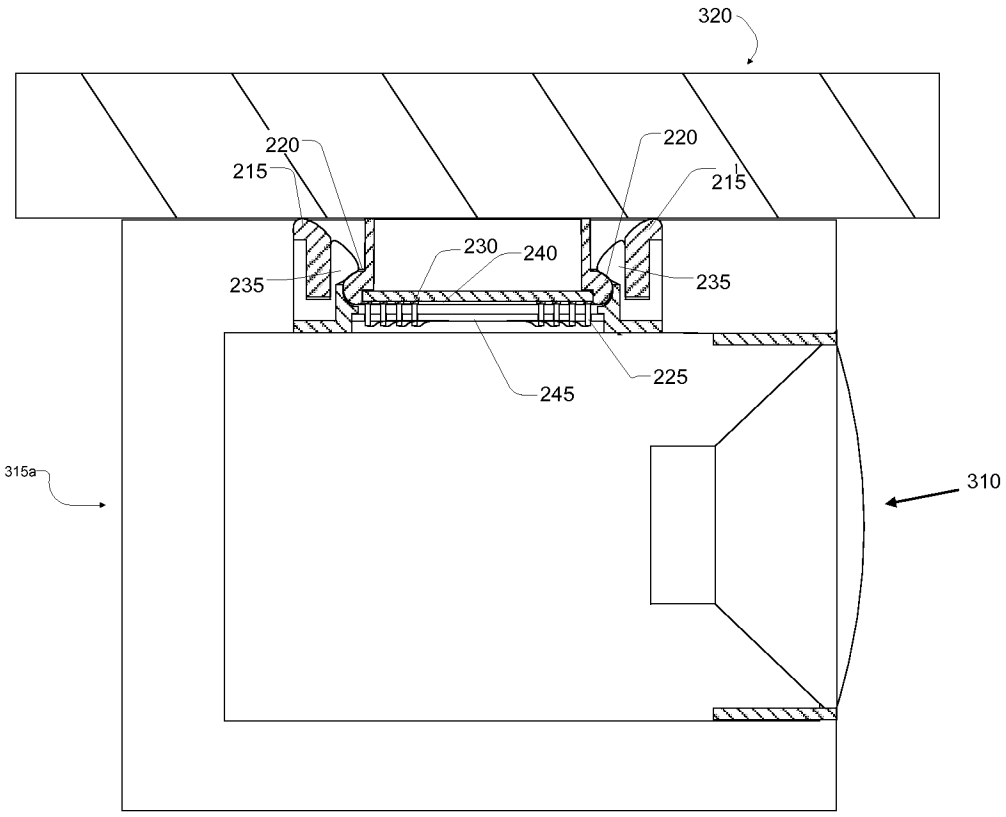
FIG. 3 shows the interfaces of FIG. 2 mated to form a coupling.

Another embodiment of a coupling of the inventive concept is shown in FIG. 2A, which shows examples of individual interfaces, and FIG. 3, which shows the interfaces of FIG. 2A mated to form a coupling. The upper portion of FIG. 2A shows orthogonal 200A, cross section 200B and cross section 200C (showing an outer portion separated from a central portion) of one interface. The interface includes a housing 210, a number of concentrically arranged circular contacts 230, and a central portion 250 having a surface 240 with features that support the circular contacts 230. As can be seen in cross section 200B, the body 210 includes a first engaging feature in the form of a projecting ridge 220 and a second engaging feature in the form of a groove 223. The housing 210 forms a hollow space 260 that allows for the fitting of an electronic component and/or a non-electronic device inside the housing 210. It should be appreciated that the first and/or second engaging features can be a separate part from housing 210 such that any or both could be of a distinct material from housing 210. A second interface that is configured to mate with the interface of 200A, 200B, 200C to form a rotatable connector is shown in the lower portion of FIG. 2A in an orthogonal view 205A, a cross section view 205B and a cross sectional view 205C which shows a partially exploded view. The interface includes a configurable cylindrical space 270 that is open and substantially defined by an outer ring 272, a back support 274 and a number of tabs 235 arranged along the inner periphery of the outer ring 272. A circular body 215 (which can be made of a resilient material) that reversibly fits inside configurable cylindrical space 270, a tab limiting feature 280, a sideways limiting feature 282 and a stop point feature 284 are also shown. Such features can serve to provide mechanical strength (for example, by applying static force to tabs) and to control rotation of the assembled coupling. A number of projecting contacts 225, 227 and spring feature 229 that serve to impel such contacts are also shown. The projecting contacts 225, 227 are depicted as passing through apertures of central portion 245 through surface 248. Movement of such contacts is indicated by a double-ended arrow. As shown in cross section 205B, the tabs 235 are movable in the direction indicated with the associated double-ended arrow, with movement towards the center limited by the tab limiting feature 280. The circular body 215 can function as a sealing mechanism and/or as an additional spring mechanism for the tabs 235, and can be rotated within the cylindrical space 270 (which rigidly limits outerwards movement of the circular body 215). The outer ring 272 in conjunction with the back support 274 connects with tabs 235 allowing for the securing of the interface to an object in such a way that the interface can have a low profile/aspect ratio (for example, les than 2) or essentially no profile relative to the exterior of an object mounted via the resulting connector. The tabs 235 can have an inherent spring mechanism as a result of the material composition of the tabs 235 as well as their vertical length and horizontal thickness. The sideways limiting feature 282 limits lateral displacement and the stop point feature 284 limits further insertion of the mating interface of 200A, 200B, 200C into the corresponding complementary interface. When assembled as a rotatable connector (as shown in FIG. 3) the projecting contacts 225, 227 are in electronic communication with corresponding circular contacts 230 of an engaged interface, for example by means of one or more spring features 229 that impel these projecting contacts towards the circular contacts 230. In some embodiments each projecting contact 225, 227 is associated with an individual spring to provide optical continuous contact performance. Towards that end, the material of the circular body 215 can be a resilient material, such as a polymer, natural rubber, or synthetic rubber. Alternatively, such tabs can be contacted by individual segments of resilient material, springs, or similar devices in order to impel the tab back to its original position when displaced.

In another embodiment all or some of the outer ring 272, back support 274, tabs 235, tab limiting feature 280, sideways limiting feature 282, and stop point feature 284 can be combined as a single integral part 290. Such a single integrated part provides simpler assembly and improved performance.

In some embodiments the central portion 250 includes a printed circuit board having circular contacts 230 that are conductive tracks on the surface 240 of the printed circuit board. Such a printed circuit board can be reversible installed (for example, by a friction fit or by interacting with mounting features) in the interface. In other embodiments the central portion 245 can include a printed circuit board having passing apertures for the admission or through passage of projecting contacts 225, 227, where spring features 229 are secured in an electrically conductive manner (for example, by soldering) corresponding conductive tracks of the printed circuit board.

In still other embodiments the one or both interfaces of a rotatable connector can include a locking mechanism. An embodiment of such a locking mechanism can, for example, include a structure that has a format and behaves similarly to circular body 215, the structure having one or more blocks of a rigid portion of material that can be positioned between the tabs 235 and the outer ring 272 such that the rigid portion limits movement of the tabs 235, thereby inhibiting release of the coupling. Such a locking mechanism can be activated or deactivated when the mechanism is moved inside the cylindrical space 270, where the rigid blocks can be moved in or out of alignment with tabs 235. Movement of such a mechanism can result from friction between a portion of the mechanism and a coupled surface.

Figure 2B:
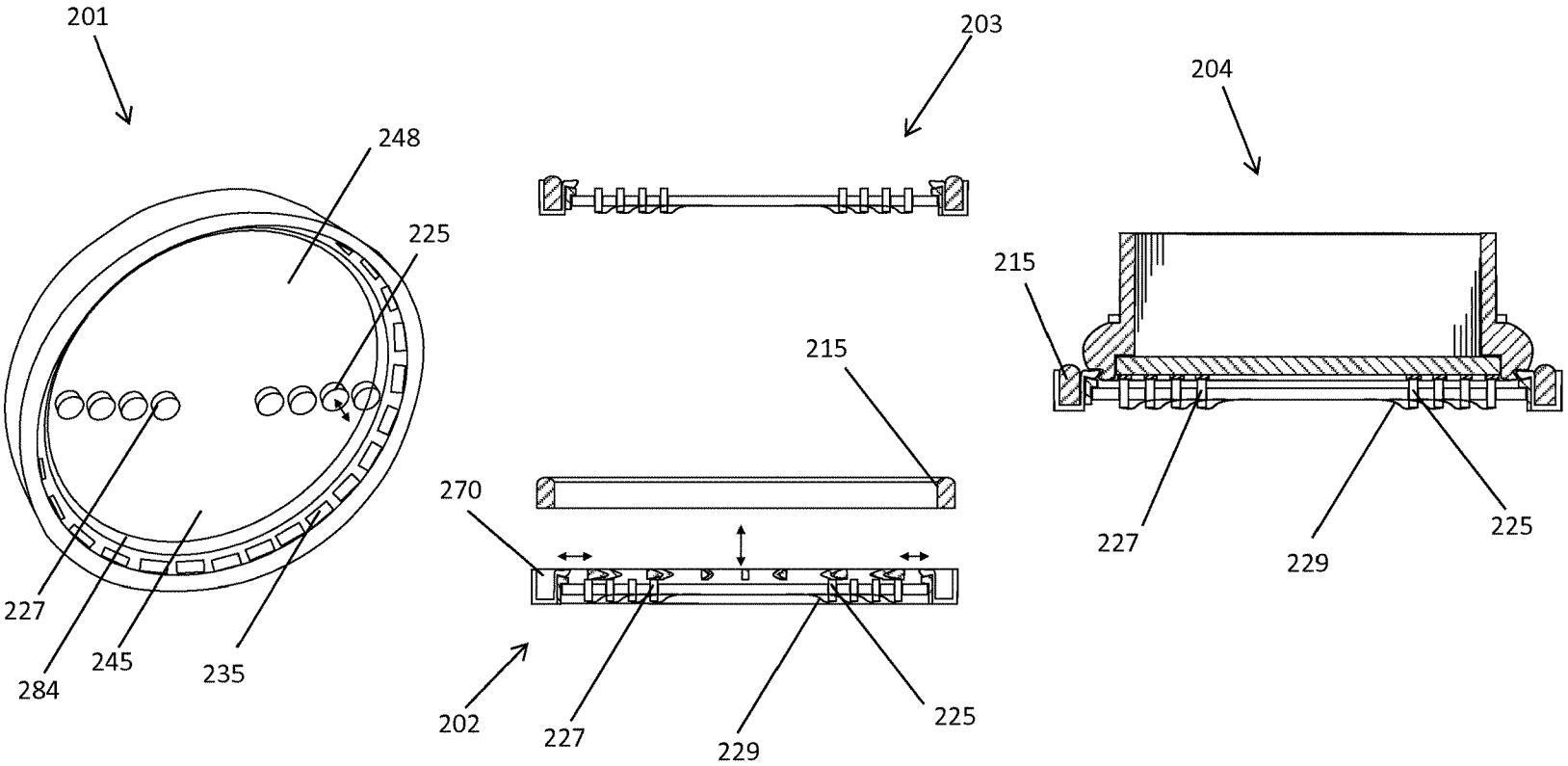

An alternative embodiment of a coupling of the inventive concept is shown in FIG. 2B, which depicts a light weight, low profile or low aspect ratio (for example, less than 0.2) interface that can be used as part of a rotatable coupling. Such a light weight interface has particular utility for small portable devices, such as a cellular phone or smart phone. As shown in an orthogonal view 201A, such a light weight interface has components that correspond to those shown in FIG. 2A. This is more apparent in a cross sectional view 201B, which shows a light weight interface with the circular body 215 removed and in functional position. As shown in a view of the assembled rotatable coupling 201C, the lightweight interface mates with a complementary interface in a similar fashion, and provides similar functionality. It should be appreciated that a light weight interface can achieve weight reduction by both reduction in one or more dimensions compared to an interface as shown in FIG. 2A, but also through the selection of materials used for construction. It should also be appreciated that, while FIG. 2B depicts an example of a light weight interface having projecting contacts, similar reductions in weight and/or aspect ratio can be applied to a complementary interface (for example, and interface having one or more concentrically arranged circular contacts). In some embodiments the interfaces can have other configurations with respect to the central portions 245 and/or 250 where for example, the stop point feature 284 and/or the single integral part 290 are configured to receive the central portion 245 through the top, thereby providing for external accessibility to this feature.

FIG. 3 shows the interfaces of FIG. 2A mated to form a coupling, which is shown as connecting an electronic device 310 (for example, a speaker) to planar surface 320. As shown, when mated the projecting ridge 220 displaces tabs 235, and are secured beneath to secure the interfaces. Due to the arrangement of the tabs 235 and the circumferential position of the projecting ridge 220 the interfaces can be rotated relative to each other. As shown, within the rotatable connector formed by mating the interfaces, the projecting contacts 225 of one interface are in contact/communicated with the circular contacts 230 of the complementary interface. The position of the projecting contacts 225 and the configuration of the circular contacts 230 maintain this communication as the interfaces are rotated relative to each other. This advantageously permits a user to orient the mounted electronic device 310 as they desire. In a preferred embodiment of the inventive concept a speaker system is provided that includes an electronic device 310 (for example, a small audio transducer that is more appropriate to emit higher frequencies such as those above 100 Hz), an interface of the inventive concept, and an enclosure 315*a* made of a material or any combination of materials that is self-supporting when the external volume of the enclosure is less than about 2,500 $cm^3$. In other embodiments the external volume is less than about 1,000 $cm^3$. In such a preferred embodiment the enclosure can have sufficient resilience to substantially return to its original configuration following deformation. The electronic device 330 can be configured to reproduce higher frequencies, such that undesirable vibrations above midrange audible frequencies are not a significant problem. The flexible configuration of such speaker system advantageously reduces the risk of injury when used within a vehicle (for example, in case of an accident). In some other embodiments the external volume of such enclosure is less than 800 $cm^3$.

In some embodiments, a coupling is formed between first and second interfaces that do not have corresponding numbers of contact features (e.g. circular and projecting contacts). For example, a first interface can be provided that is a general interface providing both power and data contacts. A second interface can be selected to form the coupling that includes complementary projecting contacts for both of these, with the coupling being used to support and provide power and data to a connected device carrying the second interface.

Alternatively, a second interface can be provided with projecting contacts that only interact with the data connections, with the coupling being used to support and provide only data to a connected device that carries or is in communication with the secondary interface (for example, a self powered smart phone). In another alternative, a second interface can be provided with projecting contacts that only interact with the power connections, with the coupling being used to support and provide only power to a connected device that carries or is in communication with the second interface (for example, a light or a charger). In yet another embodiment, a second interface can be provided that does not include projecting contacts that interact with the contacts of the first interface, with the coupling being used solely for support and orientation of a connected device carrying the second interface (for example, a smart phone utilizing Bluetooth, WiFi, or a wireless data service, a supporting shelf, a cup holder, etc.). In some embodiments of the inventive concept, an interface can include a Bluetooth and/or WiFi transmitter to support such embodiments. It should be appreciated that wireless communication devices (or components thereof) can be present in either or both of an interface configured to support projecting contacts and a corresponding complementary interface.

In some embodiments of the inventive concept, a coupling can include functional features in addition to support for a device so mounted and provision of power and/or data connections. For example, in some embodiments the interfaces that are assembled to form the coupling can include one or more openings that are aligned in the assembled coupling, where such openings permit the direction of a flow of air through the coupling in order to provide cooling. Similarly, interfaces used to form the rotatable coupling can include optical fibers that permit transmission of light through the rotatable coupling during rotation, to provide data and/or lighting.

In still another embodiment, a first interface, a second interface, or both first and second interfaces can be provided as components that support power and/or data transfer across a rotatable coupling formed by joining such interfaces, where the interface includes mechanical support features (for examples, interacting magnetic, tab, or projection and groove features) along with channels, apertures, or similar power and/or data contact support features, but that do not include power or data contacts. In such embodiments, power or data contacts can be supplied (for example, separately or as part of a kit that includes one or more interfaces) which permits a user to assemble an interface with a desired configuration by engaging the desired data and/or power contacts (if any) with their corresponding support features. Such a kit can include materials for mounting interface components and/or securing an interface to a desired device.

In a preferred embodiment, the dimensions of the interfaces are selected such that the assembled coupling has a low aspect ratio (for example, less than 0.5). For example, the first and second interfaces can be dimensioned so that a width (i.e. a maximum dimension along a plane parallel to the surface to which the corresponding interface is mounted) is at least twice that of their height (i.e. a maximum dimension along an axis normal to that of the plane defining the width) when they are assembled to form a coupling. In some embodiments, for example a low weight or low profile embodiment, the aspect ratio can be less than about 0.2. This low aspect ratio makes the coupling relatively unobtrusive and facilitates its use in a wide variety of settings—particularly in confined spaces (for example, within an automobile), and serves to improve resistance to unintended separation of mated interfaces when under load (for example, static or dynamic lateral, axial, and/or rotational forces). In some embodiments such aspect ratio applies to at least one of the interfaces. In other embodiments such height is less than about 20 mm. In still other embodiments such height is less than about 6 mm.

In some circumstances, it can be desirable to extend length of the connection provided by a connector of the inventive concept. For example, the dimensions of a mounted electronic device may be such that direct mounting to a surface (for example a wall) using a connector does not provide the desired mobility or orientation. Under such circumstances an extension, such has in the example shown in FIG. 4, can be used. The extension 400 includes an interface with concentric circular contacts 410 and an interface with protruding contacts 420 joined by a connector 430. In use, one interface is joined to a corresponding interface on the mounting structure (for example, a wall) while the remaining interface is joined with an corresponding interface on the device to be mounted (for example, a speaker). In some embodiments the connector 430 is sufficiently pliant to permit it to bend and accommodate a repositioning of the mounted device, and is also sufficiently stiff to maintain the position of the mounted device once the adjusting force is halted.

In preferred embodiments of the inventive concept, interfaces and the coupling formed by mating such interfaces are used with audio equipment. Such audio equipment can include a base. Such a base can include components such as a wireless receiver, digital media player, audio processor, amplifier, and so on. Such an audio system typically includes one or more audio transducers (for example, speakers). In some embodiments the base includes a one or more interfaces that can be mated with a complementary interface to form a rotatable coupling, where such one or more interfaces can incorporate contacts for power and/or audio data. Such an interface can be mounted on the body of the base, or can be located at a distance from the base while remaining in communication (for example, via a wired or wireless connection) while retaining rotatable support functions and power and/or data transmission capability. An audio transducer can include a second interface that mates with the first interface to form a first coupling, which permits rotation of the audio transducer. In some embodiments such an audio transducer includes a third interface, which includes power contacts and/or data contacts that derive their input from the second interface. In some embodiments, the input is diverted from a power or data contact of the second interface that is also input to a speaker or similar device of the audio transducer. In other embodiments, the audio and power contacts of the third interface receive their input from secondary power and audio contacts provided by the second interface, which in turn receive their power and audio data from a corresponding set of secondary contacts of the first interface. In some embodiments of the inventive concept, the audio transducer can include two or more such third interfaces. In other embodiments one or more of the third interface and the speaker or similar device of the audio transducer receive their audio data from the second interface via a switch or similar mechanism that permits selection between the primary or secondary contacts. This can, for example, advantageously permit a user to select between different inputs for a speaker.

A system of the inventive concept can include a secondary audio transducer that includes a fourth interface, configured to mate with a third interface as described above to form a second coupling. Similar to the coupling described above for the first and second interfaces, the third and fourth interfaces can be rotated relative to one another while maintaining power and audio contact between them, and can utilize a similar arrangement of contacts to do so. In some embodiments the third interface and the fourth interface can be rotated through at least 180° relative to one another while maintaining electrical and/or data contact across the interfaces. In other embodiments, the third interface and the fourth interface can be rotated through at least 360° relative to one another while maintaining electrical and/or audio contact across the interfaces.

In some embodiments of the inventive concept, such an audio transducer and its associated secondary audio transducer represents half of a stereo pair. Each member of a stereo pair can be placed in a different position within a room or within a motor vehicle, and rotation of their various interface pairs are independent from one another. In a preferred embodiment, each half of the stereo pair is mounted on a lateral portion of a head rest of an automobile. In such embodiments, an audio transducer and its associated secondary audio transducer can have different acoustic qualities, for example different portions of the audio spectrum reproducing more efficiently.

In a preferred embodiment of the inventive concept, the plane of the rotation between the first and second interface is normal to the plane of rotation between the third and fourth interfaces. This advantageously permits a wide range of movements for both audio transducers. For example, in a system installed on a headrest of a motor vehicle, a system of the inventive concept can permit the a stereo pair of audio transducers (and their associated speakers) to be positioned to direct sound towards virtually any position in front, to either side, and behind the associated seat. In some embodiments in which stereo pairs are utilized, corresponding planes of rotation (for example the plane of rotation between the first and second interface of each member of the stereo pair) can be arranged so that they are approximately parallel (i.e. within 30° of being parallel to one another).

In some embodiments of the inventive concept, the base can include a housing upon which is mounted the first interface. In such an embodiment, the housing can be dimensioned to permit securing the base using a safety belt of a motor vehicle. For example, in such an embodiment the base can be dimensioned to act as a central armrest for a rear seat in a motor vehicle, such that a central safety belt can be used to secure the base. In such an embodiment the housing can include padding, integrated cup holders, and other useful features.

In other embodiments, for example a system for home use, a first interface can be supplied as a wall-mounted unit, such a wall-mounted unit can, for example, be secured to the surface of the wall, for example using screws, bolts, adhesives, and/or hook and loop closures. Alternatively, a first interface can be secured using a flush mount, such that only a minimal portion of the first interface necessary for the mechanical interaction with the second interface protrudes from the wall surface. In another embodiment, a first interface can be provided on a mount that extends away from the wall surface, and which can be pivoted, rotated, or otherwise positioned to provide an additional degree of positional flexibility.

In embodiments in which the audio transducers are mounted on a headrest of a seat of an automobile, it should be appreciated that the first interface can be applied or affixed to the headrest in any suitable manner. For example, the first interface can be provided with a plurality of pins that penetrate the surface of the headrest and secure the first interface through friction with the padding of the headrest. Alternatively, the first interface can be affixed to a flexible and/or elastic band that is sized to fit securely around the headrest. In another embodiment, the first interface can be secured to the headrest using a rigid or semi-rigid bracket that is secured to the headrest, for example through the use of an adjustable closure. In still another embodiment of the inventive concept, the first interface can be supplied with a hook fabric that engages the pile of the upholstery associated with the headrest. In yet another embodiment, the first interface can include a reversible adhesive that permits the first interface to be affixed to the headrest in a reversible manner. It should be appreciated that such mounting approaches advantageously do not require the use of tools for installation of the system, reconfiguration of the system with alternative components, and/or adjustment of the orientation and/or position of components comprising the system, and additionally permit a system of the inventive concept to be utilized in a motor vehicle without modification of the vehicle and with little to no damage to the motor vehicle. It should also be appreciated, however, that a headrest or similar structure (including a vehicle headrest) can be manufactured with at least one of the first interface outward facing or with a mount for securing the first interface. Such headrests can, for example, be supplied with a motor vehicle from the manufacturer or supplied as after-market items.

It should be appreciated that the coupling formed between the first and second interfaces and between the third and fourth interfaces can be readily reversible (i.e. able to be disengaged and reengaged by a typical user without the use of tools). This "plug and play" feature not only advantageously greatly simplifies both replacement of defective or damaged components, but also permits the user to easily customize the performance of the audio system. For example, a user may have a selection of different audio transducer and secondary audio transducers with different acoustic characteristics available, and mix them via their complementary interfaces to provide an audio system with the desired performance. Alternatively, audio transducer can be provided in different colors and/or exterior finishes, thereby allowing a user to customize the appearance of the audio system. In some embodiments a "hot swap" (i.e., an exchange of system components without shutting down the system) can be performed conveniently by a user via a simple manual disengagement of an existing component by separation of the interfaces of a system coupling and engagement of an interface of a new component by mating with a complementary interface of the powered system.

In some embodiments of the inventive concept, components other than audio transducers are provided that have interfaces compatible with those of the system. For example, various devices can be provided that have interfaces similar to the second or fourth interfaces but that are configured to draw power from respective first or third interfaces, and can, similarly, be rotated into a wide variety of positions. Examples of such devices include fans, a light (for example an LED light), a portable telephone or a support for a portable telephone (for example, a smart phone), a tablet computer, and/or a portable navigation system. In other embodiments, a system of the inventive concept can include a microphone that acts as an audio source that is directed through a series of audio contacts through the base and to a cellular telephone circuit. In still other embodiments, a holding device can be fitted with an interface that only provides a mechanical connection to a first or third interface. Such holding devices include mounts or stands for passive or self-powered devices such as a cup, beverage container, portable telephone, tablet computer, and/or portable navigation system. It should be appreciated that the transducers and/or other devices that are reversibly secured and that can have their positions adjusted as described above can utilize wireless communication in addition to or in replacement of the wired connection methods of the above described embodiments.

In some embodiments of the inventive concept interfaces, such as the first and second interfaces, can support communication other than power and audio data. For example, the first and second interface (and other interface pairs) can support communication of video data, data from various sensors (temperature, humidity, acceleration, position, and so on), and can provide a data interface with a data network (for example a wireless data). This permits inclusion of a wide variety of functional devices into the system notably video cameras.

In an alternative embodiment of the inventive concept, a speaker or similar audio transducer is supplied in an enclosure that is configured to be secured to a seat of a motor vehicle. Such an enclosure can be constructed of light weight materials (for example, materials that provide a weight of less than 10 kg for the system and/or less than 5 kg for an automobile seat-mounted speaker), and can include components (for example pliant or flexible materials) that reduce vibration of the enclosure when the motor vehicle is in operation and/or when the audio transducer is in use. For example, such an enclosure can include features (for example, an aperture) that permits a portion of the vehicle's passenger safety system (for example, a safety belt) to be passed through or around the enclosure, holding the enclosure in place when secured. Such an embodiment can optionally include one or more interfaces as described above, or can be lacking in such interfaces. In some embodiments of the inventive concept, such a seat-mounted device can be connected directly to the vehicles audio system using a wired or wireless connection rather than through an interface as described above.

Figure 5:
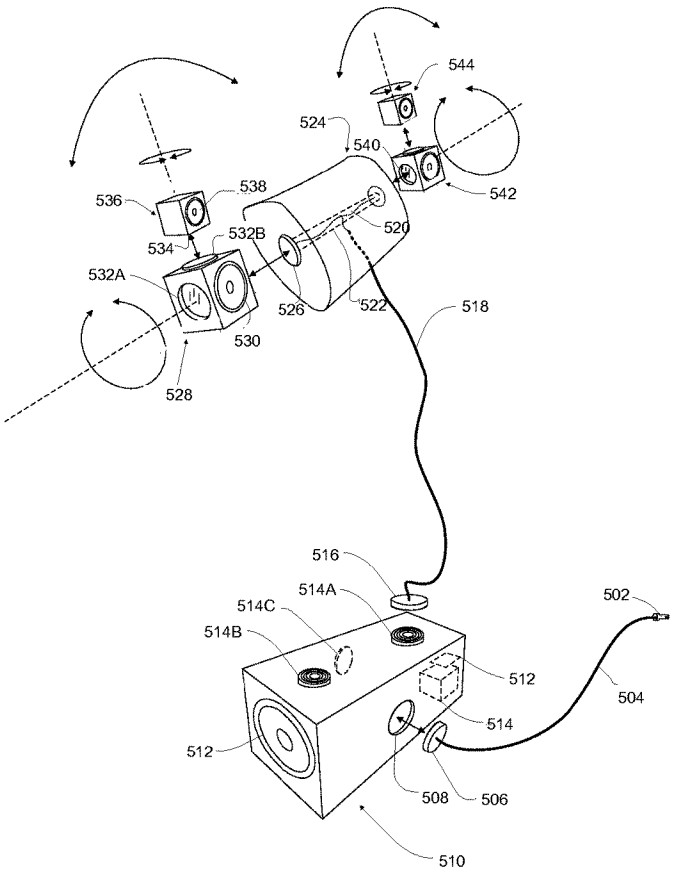
FIG. 5 depicts a partially exploded view of a system of the inventive concept as installed in an automobile.

Examples of various embodiments of the inventive concept are depicted in FIGS. 5 to 16. FIG. 5 depicts a portable and/or configurable audio system of the inventive concept that is suitable for use in an automobile. As shown, an input for a power supply and/or audio signal 502 is connected via a cable 504 or similar device to an interface 506. The interface 506 mates with a complementary interface 508 that is mounted on a base 510. It should be appreciated that in some embodiments the base 510 can receive audio data from a wireless source, for example via radio, WiFi, Bluetooth, and similar technologies. Similarly, a base 510 can include one or more data ports (for example, memory card, USB, lightening, and/or firewire ports) for connection of data devices, such as a flash drive or portable hard drive. The base 510 can include and audio processor 514 and can include a wireless receiver 512. In some embodiments the base 510 includes a speaker 512, which can be constructed for reproduction of low frequencies. In a preferred embodiment, the base 510 is dimensioned to fit beneath an automobile seat. The base 510 can include one or more additional interfaces 514A, 514B, 514C that can interface with complementary interfaces to form couplings with additional devices. As shown a complementary interface 516 provides audio data via a cable 518 that runs to a channel 522 within a headrest 524 and forms a T-shaped connection with an extended lead 520. The extended lead 520 provides audio data to interfaces mounted on the headrest, one of which 525 is visible in this view. Interface 525 interfaces with a complementary interface (not visible in this view) of a secondary device 528 to form a coupling that mounts the secondary device to the headrest in a rotatable manner. Secondary device 528 includes a speaker 530, which can be designed to reproduce midrange and/or high audible frequencies, and additional interfaces 532A, 532B. It should be appreciated that such a secondary device 528 can include additional interfaces that are not visible in this view. It should be appreciated that such additional interfaces can be positioned on different surfaces or faces of such a secondary device, thus permitting a single secondary device design to be suitable for use on either side of the headrest. As shown in this figure, one of these additional interfaces 532B can mate with a complementary interface 534 of a tertiary device 536 to form a coupling between the secondary device 528 and the tertiary device 536 that permits rotation relative to the secondary device 528. It should be appreciated that the tertiary device 536, when equipped with a suitable complementary interface, could also be coupled to another interface within the system to provide a different orientation, if so desired by a user. Alternatively, tertiary device 536 could be coupled to interface 526, for example to provide a configuration with improved reproduction of high frequencies. The tertiary device 536 also includes a speaker 538 that can be designed for reproduction of high audible frequencies. As shown, the remaining end of extended lead 520 can provide audio data to a headrest-mounted interface (not visible in this view) that mates with a complementary interface 540 of an additional secondary device 542, which has a configuration that is similar to secondary device 528, to form a coupling that permits rotation relative to the headrest. Secondary device 542 also includes additional interfaces that can mate with a complementary interface on an additional tertiary device 544 to form a coupling that permits rotation relative to the additional secondary device 542.

Figure 6B:
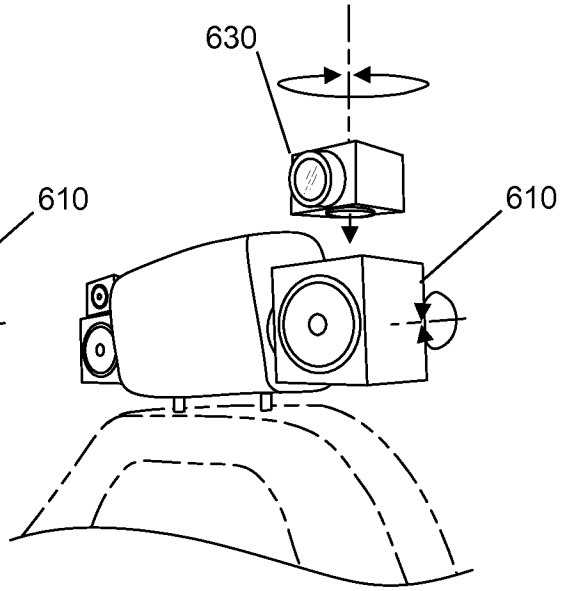
FIGS. 6A and 6B depict alternative devices that can be joined to a system or device carrying an interface of the inventive concept.
Figure 6A:
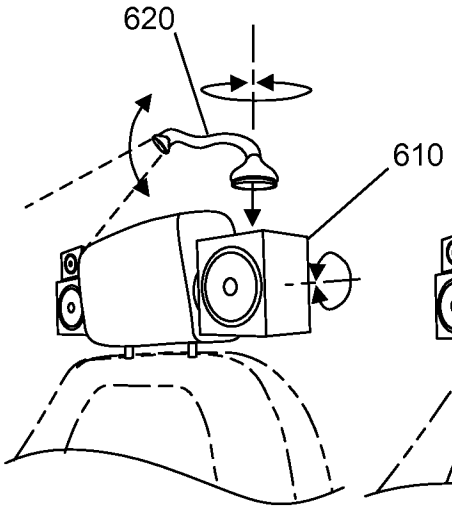

Another example of an embodiment of the inventive concept is shown in FIGS. 6A and 6B. FIG. 6A shows a headrest similar to that shown in FIG. 5, where one of the tertiary devices has been replaced with a light 620 that includes an interface that is complementary to an interface located on the upper surface of a headrest speaker unit 610. The coupling can supply power to the light while providing mechanical support, and permits rotation of the light relative to the speaker 610. Alternatively, the light 620 can be self powered and the coupling used to provide mechanical support and provide rotation. FIG. 6B shows an alternative embodiment in which a camera 630 includes an interface that mates with a complementary interface on a headrest speaker unit 610 to form a coupling that permits rotation of the camera 630 relative to the headrest speaker unit 610. In such an embodiment the coupling can provide power and mechanical support, and can additionally allow the transfer of video data from the camera 630 through the connector to a base unit or other connected device. Alternatively, such a coupling can provide only power and mechanical support, with the camera 630 storing video data internally and/or transmitting video data wirelessly. In still another embodiment, the coupling provides only mechanical support to and permits rotation of the camera 630.

Although shown as attached directly to a surface in FIGS. 5, 6A, and 6B, it should be appreciated that interfaces of the inventive concept can be affixed via an intermediate structure, for example an adjustable and/or elastic band. Examples of this are shown in FIG. 7A, which shows an interface 710 mounted on an elastic band 720, and FIG. 7B, which shows an interface 710 mounted on a band 740 that includes a device 730 for adjusting the length of the band 740. Suitable devices include buckles, straps, laces, ties, latches, and hook and loop closures. In some embodiments such a band 740 can be inelastic; in other embodiments at least a portion of such a band 740 can be elastic. In still other in other embodiments the intermediate structure can include one or more portions of rigid or pliable material connected to an elastic or partially elastic band such that for example, a soft headrest (for example a cushion or pillow) is not be substantially deformed by mounting of an interface of the inventive concept utilizing such a band.

Figure 7B:
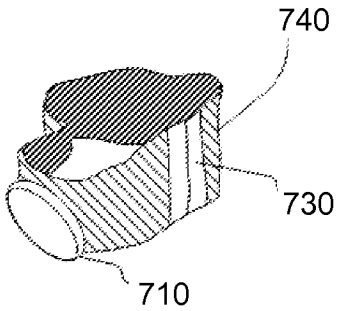
FIGS. 7A and 7B depict embodiments where an interface of the inventive concept is affixed to a strap or band.
Figure 7A:
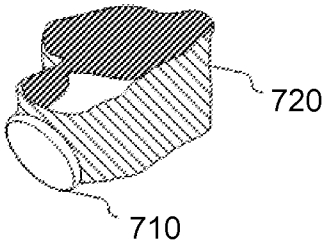
Figure 8B:
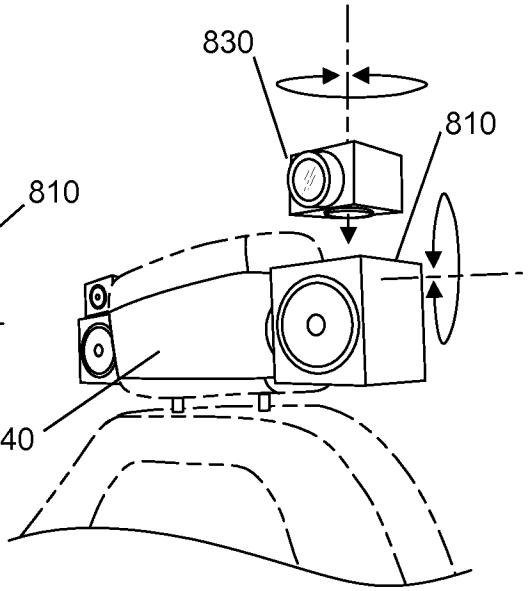
FIGS. 8A and 8B depict alternative devices that can be joined to a system or device carrying an interface of the inventive concept, where the interface is affixed using a band as depicted in FIG. 7A or 7B.
Figure 8A:
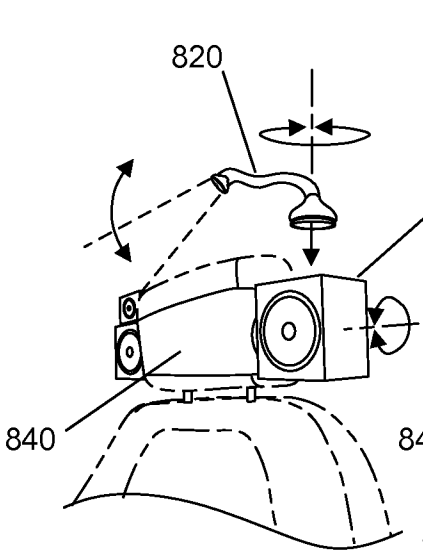

FIGS. 8A and 8B depict alternative embodiments that are similar to those shown in FIGS. 7A and 7B, but in which the interfaces associated with the headrest are not mounted directly but rather via a band. FIG. 8A shows a headrest similar to that shown in FIG. 7A, where a headrest interface used to form a coupling with headrest speaker unit 810 is mounted on a band 840 that is affixed to the headrest. One of the tertiary devices has been replaced with a light 820 that includes an interface that is complementary to an interface located on the upper surface of a headrest speaker unit 810. The coupling can supply power to the light while providing mechanical support, and permits rotation of the light relative to the speaker 810. Alternatively, the light 820 can be self powered and the coupling used to provide mechanical support and provide rotation. FIG. 8B shows an alternative embodiment in which a camera 830 includes an interface that mates with a complementary interface on a headrest speaker unit 810 to form a coupling that permits rotation of the camera 830 relative to the headrest speaker unit 810. In such an embodiment the coupling can provide power and mechanical support, and can additionally allow the transfer of video data from the camera 830 through the connector to a base unit or other connected device. Alternatively, such a coupling can provide only power and mechanical support, with the camera 830 storing video data internally and/or transmitting video data wirelessly. In still another embodiment, the coupling provides only mechanical support to and permits rotation of the camera 830.

Figure 9A:
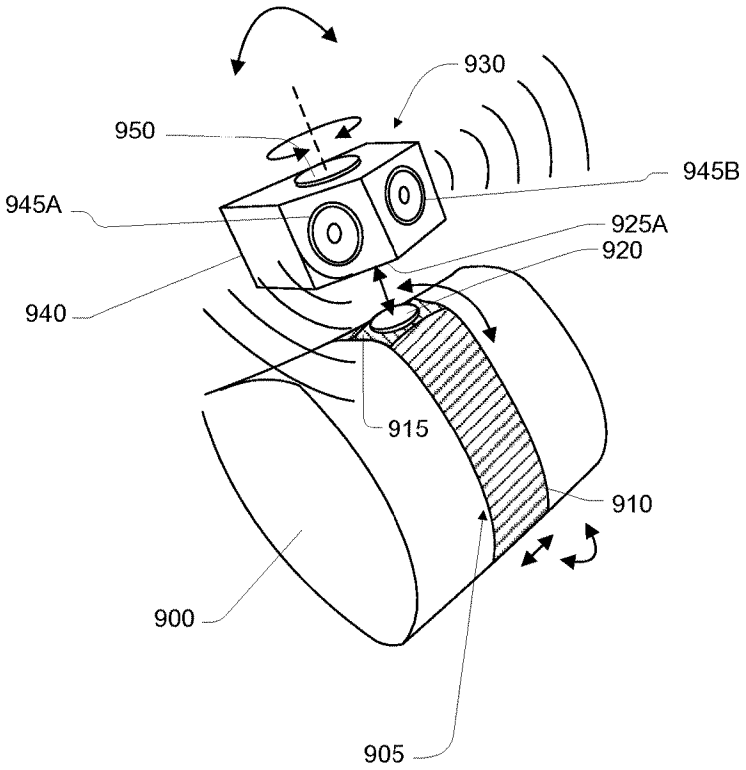
FIGS. 9A to 9D depict embodiments of the inventive concept wherein various devices carrying interfaces of the inventive concept are coupled to an automobile headrest carrying a complementary interface by mating the interfaces, thereby forming a rotatable coupling.

FIG. 9A shows an embodiment of the inventive concept in which a band 905 utilizes an elastic material 910 to secure an interface 920 to a headrest 900. In some embodiments the interface 920 is mounted to a base 915 that is incorporated into or attached to the band 905. The A speaker unit 930 includes a housing 940 upon which is mounted a complementary interface 925A that mates with the interface 920 to form a coupling that provides mechanical support and audio data to the speaker unit 930 while permitting it to be rotated relative to the head rest 900. The speaker unit 930 includes a pair of speakers 945A and 945B, and can include an additional interface 950 that can be used to form a coupling with an interface of an additional device.

Figure 9B:
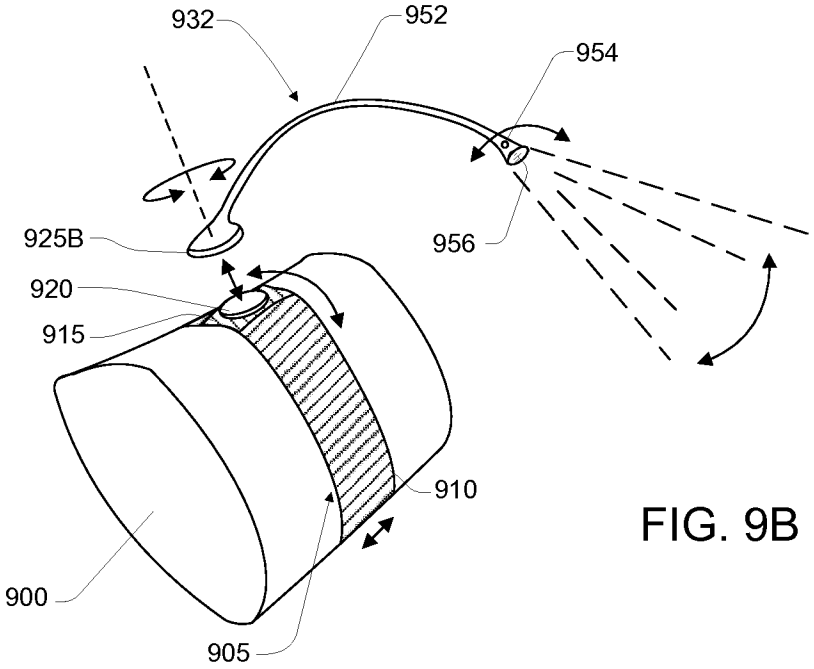

FIG. 9B shows the headrest of FIG. 9A, where the speaker unit has been replaced by a lamp 932. The lamp 932 includes an interface 925B that is complementary with the interface 920, and can mate with it to form a connector that can provide both mechanical support and power to the lamp 932 while permitting it to swivel. Alternatively, the lamp can be self powered and the connector used to supply mechanical support and rotation only. The lamp 932 includes an arm 952, which can be pliant in order to direct the lamp more accurately, a diffuser 954, and a light source 956 (for example, an incandescent lamp, a fluorescent lamp, and/or an LED).

Figure 9C:
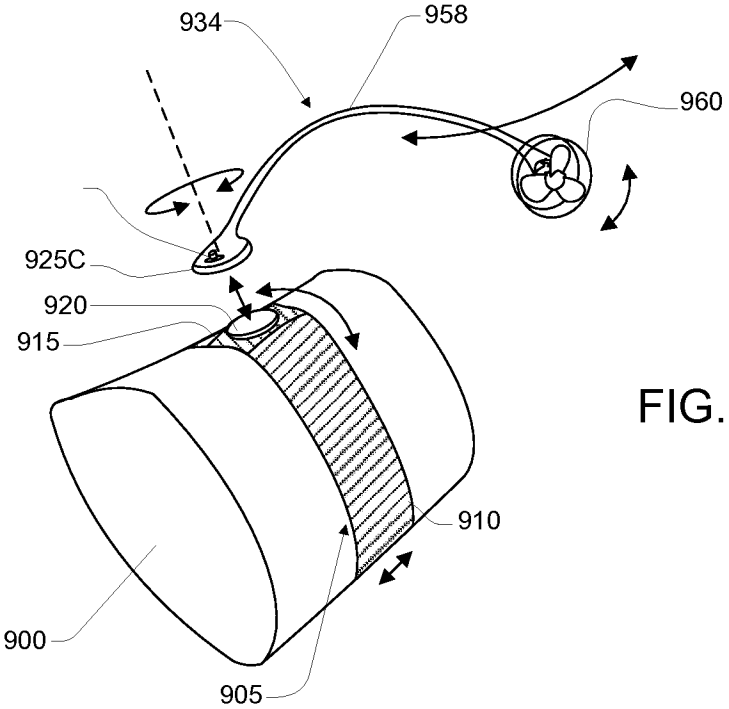

FIG. 9C shows the headrest of FIG. 9A, where the speaker unit has been replaced by a fan 934. The fan 934 includes an interface 925C that is complementary with the interface 920, and can mate with it to form a connector that can provide both mechanical support and power to the fan 934 while permitting it to swivel. Alternatively, the fan 934 can be self powered and the connector used to supply mechanical support and rotation only. The fan 934 includes an arm 958, which can be pliant in order to direct the fan more accurately, and a blower 960.

Figure 9D:
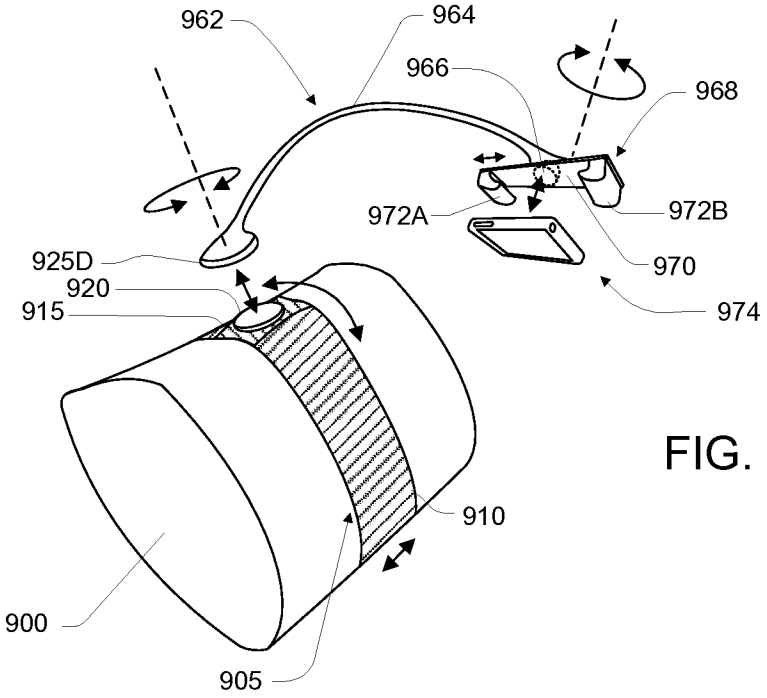

FIG. 9D shows the headrest of FIG. 9A, where the speaker unit has been replaced by a cell phone holder 968. The cell phone holder 968 includes an interface 925D that is complementary with the interface 920, and can mate with it to form a connector that can provide both mechanical support and power to the cell phone holder 968 while permitting it to swivel. Alternatively, the cell phone holder 968 can be self powered and the connector used to supply mechanical support and rotation only. The cell phone holder 968 includes an arm 964, which can be pliant in order to direct the fan more accurately. Such an arm can terminate in a swiveling or rotatable connector 966 that is coupled to a device designed to secure a cell phone 974 while retaining access to the telephone's functions. For example, such a device can include a base plate 970 that terminates in two clips 972A, 972B that provide a frictional contact with opposing termini of the cell phone 974 when mounted.

Figure 10:
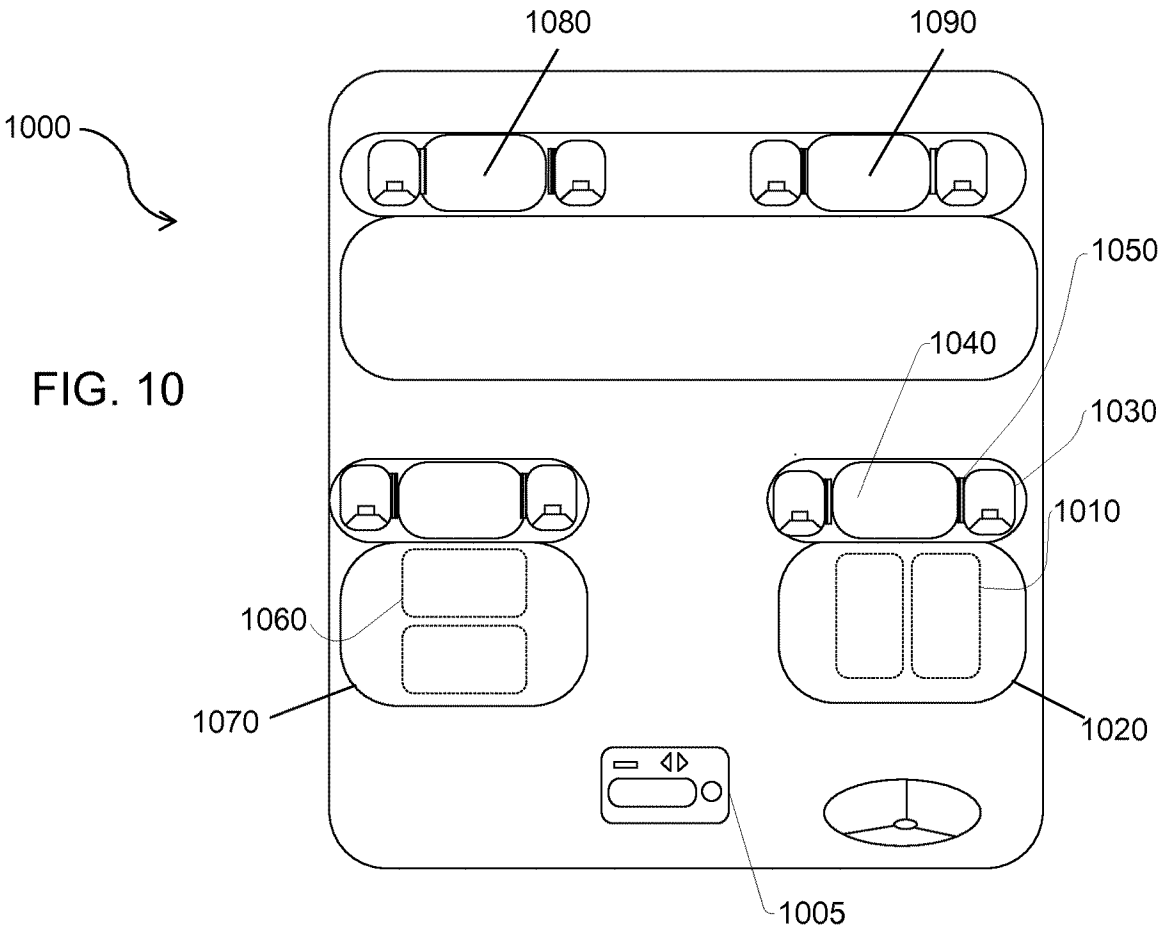
FIG. 10 shows an example of an arrangement of components within a system of the inventive concept, as installed in an automobile.

FIG. 10 depicts a configuration for installation of a system of the inventive concept in an automobile. As shown one or more base units 1010 can be placed (either permanently or removably) beneath a driver's seat 1020 to receive audio data from an automobile sound system 1005 (for example, wirelessly) and fitted with one or more interfaces (not shown) that provide an audio and/or data connection to a headrest 1040. It should be appreciated that such a base unit can also receive audio data from a portable electronic device, for example through a wireless connection. The headrest includes a connector 1050 formed by the mating of a headrest interface and a speaker unit 1030 interface. In a preferred embodiment, where an axis of connection and/or rotation of such an interface is substantially normal to a surface of the headrest or substantially horizontal and the audio output can be adjusted at least 180° in a vertical plane. As shown, similar base units 1060 are placed beneath the front passenger seat 1070, but in an alternative orientation. Similarly, the headrests 1080, 1090 of the rear passenger seats are also equipped with couplings used to mount speaker units. In some embodiments, a vehicle can be manufactured including one or more fittings or receptacles that allow for the installation of two or more interfaces to one or more of such headrests.

Figures 11A, 11B, 11C, 11D:
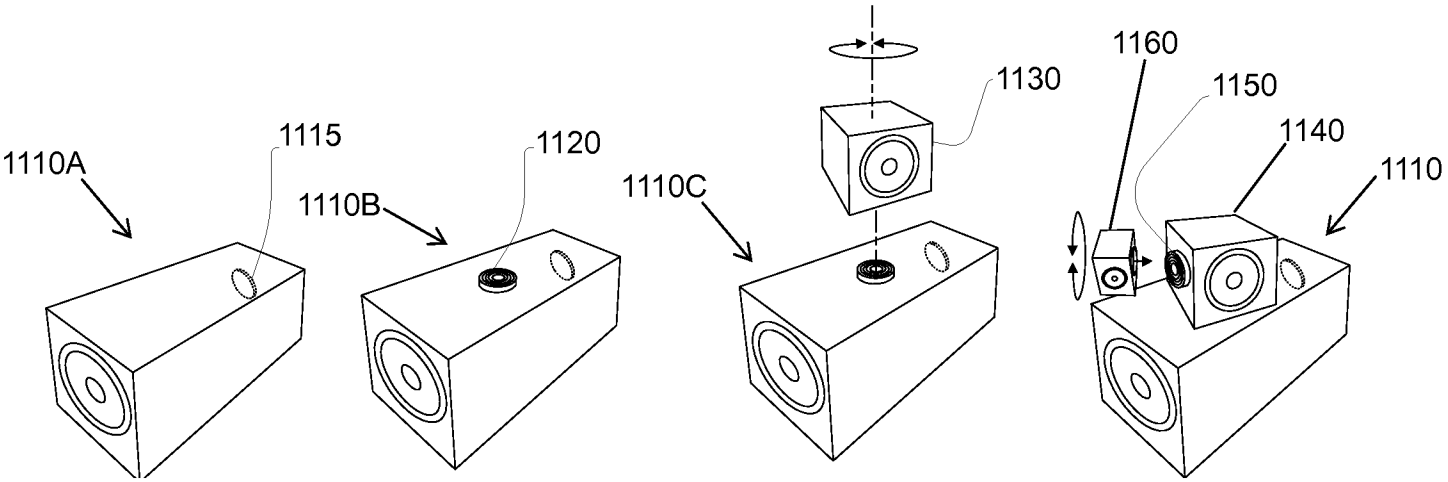
FIGS. 11A to 11D show examples of speaker systems that incorporate interfaces of the inventive concept.

As shown in FIGS. 11A, 11B, 11C, and 11D a base unit can be configured with interfaces in different numbers, positions, and orientations. FIG. 11A depicts a base unit 1110A with a single interface 1115 that supports connection to an audio signal, for example wirelessly, where the interface can secure the weight of the base unit to another interface during rotation of the base unit. FIG. 11B depicts a base unit 1110B that includes the interface of base unit 1110A and includes an additional interface 1120 at a different orientation. As shown in FIG. 11C, a similarly configured base unit 1110C can utilize such an additional interface to form a coupling by mating with a complementary interface of a speaker unit 1130. In some embodiments, such as the one depicted in FIG. 11D, a base unit 1110D can be coupled to a speaker unit 1140 by mated interfaces, and such a coupled speaker unit can include an interface 1150 that in turn can be mated with a complementary interface on an additional speaker unit 1160 to form a coupling. Each of the couplings shown in FIGS. 11A, 11B, 11C, and 11D can provide rotation, permitting a wide range of easily customizable configurations for the resulting sound system.

Figure 12C:
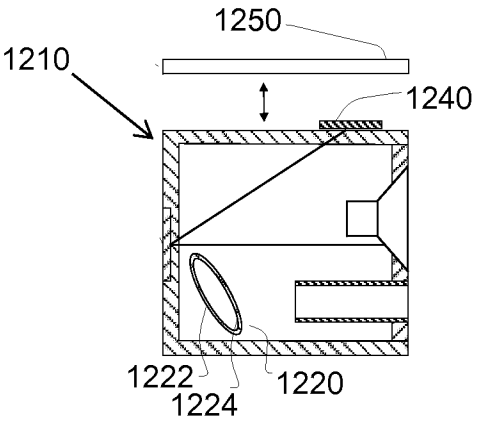
FIGS. 12A to 12C depict a portable speaker of the inventive concept that is configured to be secured using a seat belt or other restraining belt.
Figure 12B:
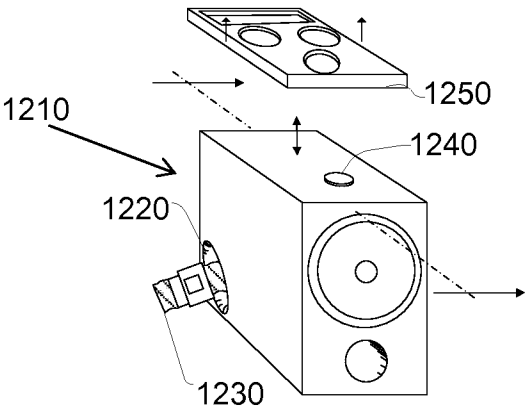
Figure 12A:
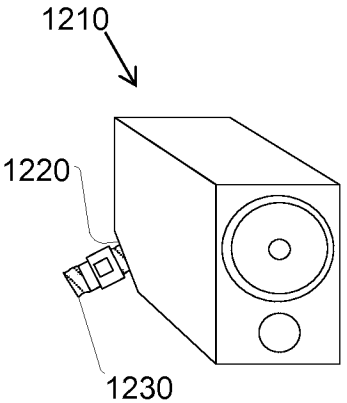

Systems of the inventive concept can be readily portable. For example, as shown in FIGS. 12A, 12B, and 12C, such a system can be configured to be easily attached to a car seat. As shown in FIG. 12A, a base unit 1210 can include a channel 1220 through which a seat belt 1230 can be passed. Buckling and tightening the seat belt 1230 secures the base unit 1210 in place. As shown in FIG. 12B, such a base unit can include an interface 1240 that permits a user to couple a device having a complementary interface to the base unit. In some embodiments, a tray 1250 can be provided that attaches to an upper surface of the base unit 120. FIG. 12C shows a cross sectional view of such a base unit 1210, showing a channel 1220 that includes a wall 1222 and a lumen 1224 through which a seat belt can pass. In some embodiments of the inventive concept such a seat-mounted device can include a tensioning device (for example, a spring) that interacts with the securing seat belt to keep the seat belt under tension.

Figure 4:
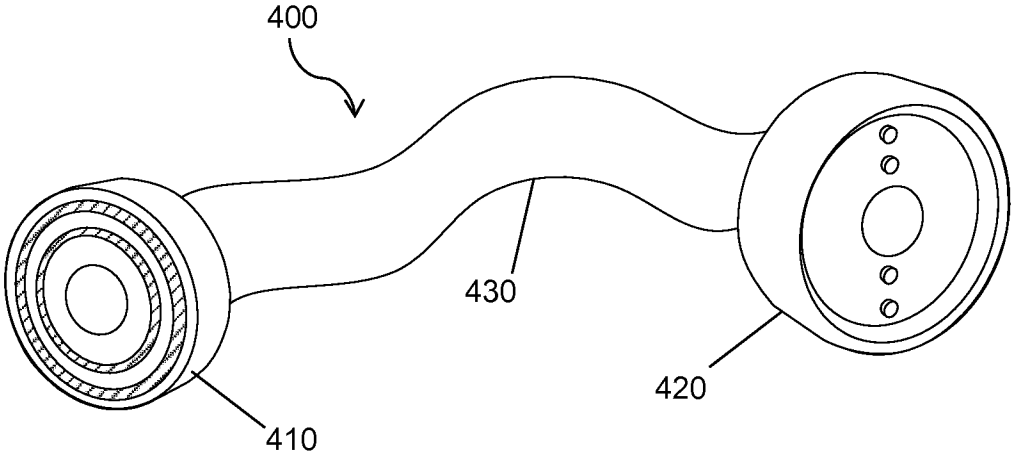
FIG. 4 depicts an extension that can be used to bridge between interfaces of the inventive concept.
Figure 13:
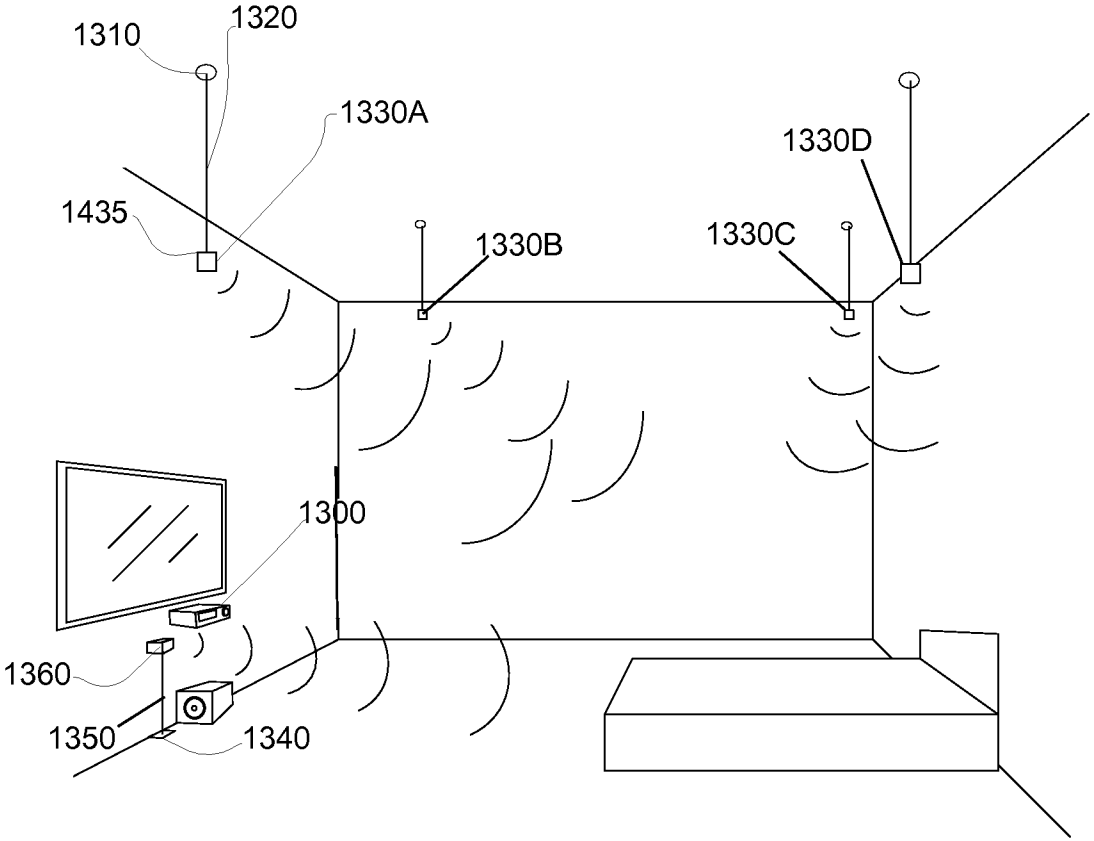
FIG. 13 shows an example of an arrangement of components within a system of the inventive concept, as installed in a bedroom.

Although the above examples have focused on automotive applications, it should be appreciated that devices and systems of the inventive concept can also be utilized in a home and/or office setting. An example of this is shown in FIG. 13. As shown a source unit 1300 (for example, a radio, CD player, DVD player, Blu-Ray player, digital media player, or any suitable audio, video, or data source) can provide audio data to a coupling 1310 produced by mating a ceiling mounted interface with a complementary interface that forms part of an extension (for example, as shown in FIG. 4), having a connecting region 1320 that extends to an interface that forms part of a coupling 1335 that provides a connection to a satellite speaker 1330A. Similar arrangements provide audio feeds to satellite speakers 1330B, 1330C, and 1330D. In addition, a floor mounted coupling 1340 formed using an interface that is part of an extension that has a rigid connecting piece 1350, and which in turn forms a connection with an additional, floor mounted satellite speaker 1360. Alternatively, an independently movable floor mount incorporating a base and a pair of interfaces joined by a rigid connecting piece can be used.

Figure 14B:
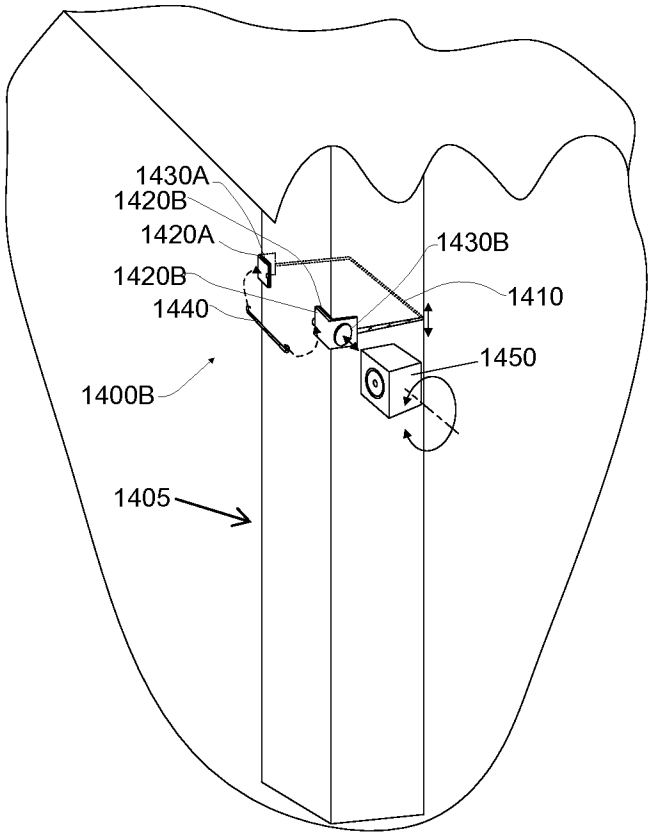
FIGS. 14A and 14B depict examples of an embodiment of the inventive concept that permits attachment of interfaces to a pillar or similar structure.
Figure 14A:
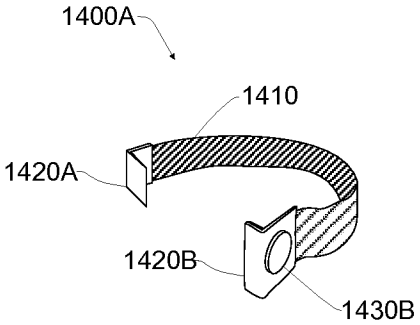

As noted above, an interface capable of forming part of a coupling can be mounted to a flexible and/or elastic band that permits temporary mounting to suitable fixtures. As shown in FIGS. 14A and 14B, such an embodiment facilitates attachment of an interface of the inventive concept to a vertical pillar or similar feature within a structure. As shown in FIG. 14A, such a device 1400A can include a band 1410 and hooked portions 1420A and 1420B. As shown an interface 1430B can be mounted to a hook portion. A device as depicted in FIG. 14A is shown mounted to a rectangular pillar in FIG. 14B 1400B. As shown, hook portions 1420A and 1420B can grasp adjacent corners of such a pillar 1405, and provide two interfaces 1430A and 1430B. Such interfaces can be mated with a complementary interface on a speaker unit 1450 to provide a coupling that affixes the speaker unit 1450 to the pillar 1405 while permitting rotation. The band 1410 can be sufficiently elastic or provide sufficient tension to secure the device to the pillar. In some embodiments additional support can be provided through the use of an additional tensioning cord 1440 that attaches to the hook portions 1420A, 1420B.

An alternative embodiment of the inventive concept is a portable audio device that is intended to be worn, for example as part of a garment or other worn item that can secure a portable audio device to a user (e.g, shoulder straps, jacket, coat, sweatshirt, and/or shirt) or stowed within a worn pack (such as a rucksack, book bag, unframed backpack, and/or framed backpack) such that it is not in direct contact with the head of a user. In such an embodiment an audio processor is utilized to divide a supplied audio signal into a low frequency signal and a remaining audio signal. In some embodiments a first transducer for lower frequencies can be positioned in the torso area of a user and a second transducer can be reversibly coupled to the first transducer such that higher frequencies can be directed towards the ear of the user. In other embodiments the low frequency signal can include primarily (for example greater than 50%, 60%, 70%, 80%, 90%, or more than 90%) audio frequencies that are below the range of normal human hearing but that are perceptible by then user as vibration. This low frequency signal is directed to an transducer (for example, a low frequency speaker) that translates this low frequency signal to vibration and directs this vibration to the torso of an individual wearing the portable device. Remaining frequency signals, which can be audible, are directed to satellite speakers located near the wearer's head, for example as speakers mounted within a back pack (but oriented to direct high frequencies out), mounted within or on a hood of a jacket, or that project from a backpack (for example, being adjustable to be oriented toward the ears of the user. Such satellite speakers can receive their audio feed through a coupling as described above, with the garment or pack having two or more interfaces distributed on its surface and permitting simple and effective flexibility in the positioning of the satellite speakers.

In other embodiments a screen or other sound-permeable material at least partially encloses an upper portion of a garment or pack supporting a portable audio system, such that sound from the high frequency speakers can be directed towards the head of the user while being protected. In still other embodiments a leveling mechanism (for example, and adjustable support or adjustable strapping mechanism) can be implemented to permit a user to adjust the level of a base unit of the portable system (for example, incorporating the low frequency speaker) relative to the top of the garment or pack. In some embodiments this includes a strap that secures the bottom of a base unit at various adjustable levels, the strap having a securing feature (such as buckles, snaps, zippers, or hook and loop material) that reversibly attach to a vertical supporting feature (for example, a strip of complementary material+that allows for the user to change the position of the strap inside the garment or pack. In some embodiments the high frequency transducer incorporates similar adjustment features.

In some embodiments a multichannel and/or multi-transducer portable audio configuration that can be configured for use as surrounding the user with protocols such as THX, Dolby Surround and the like is provided. In such embodiments the multi-transducer system can be wired and/or or wireless connected, for example using RF, WiFi, or Bluetooth.

Figures 15A, 15B, 15C, 15D:
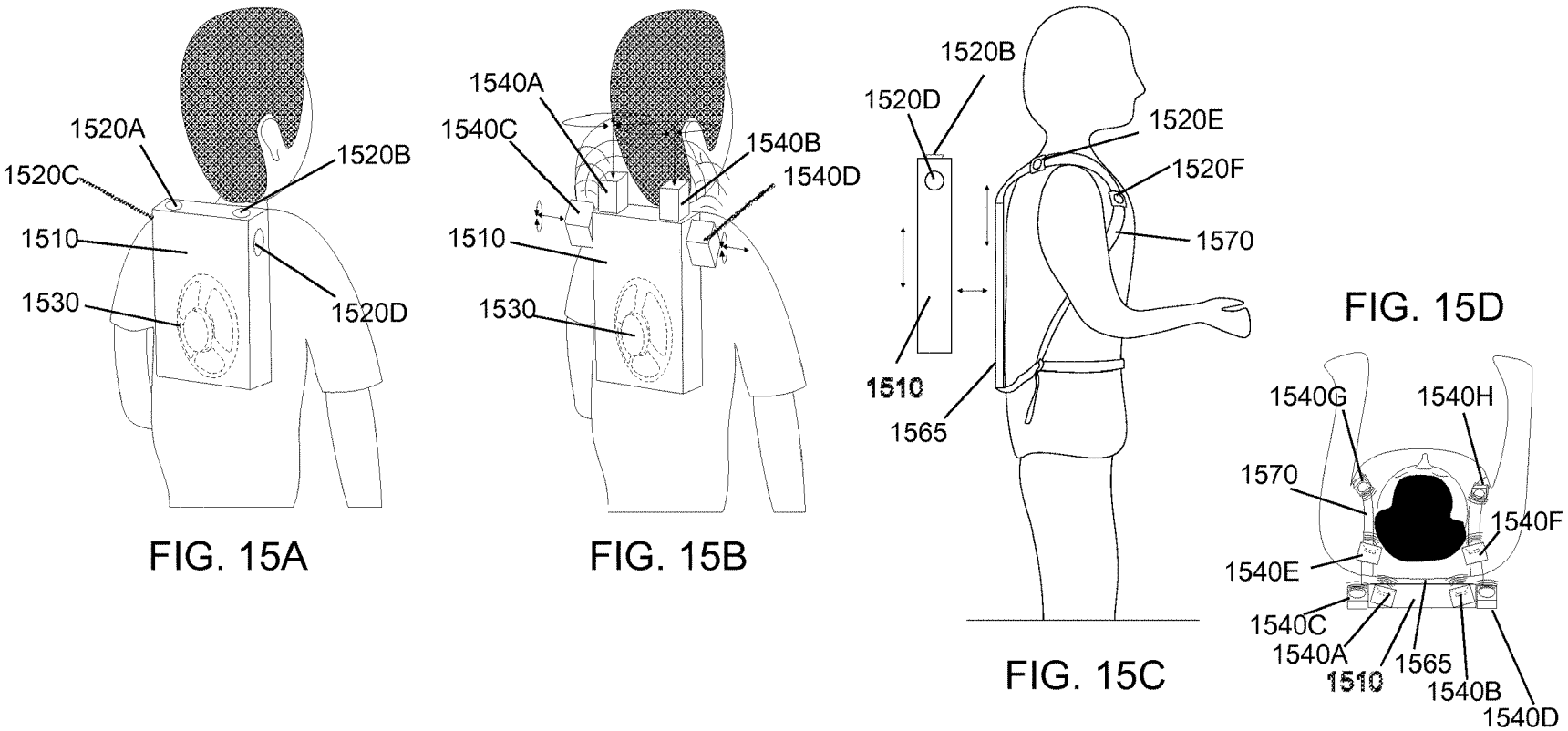
FIGS. 15A to 15D depict examples of wearable embodiments of the inventive concept.

Examples of such embodiments are shown in FIGS. 15A, 15B, 15C and 15D. FIG. 15A depicts a base unit in a partial cutaway view of a backpack 1510 of such an embodiment, showing a low frequency transducer 1530 oriented to direct the vibration to the wearer's torso or trunk, and interfaces 1520A, 1520B, 1520C (not visible), and 1520D that receive an audible audio signal or mechanically secure wireless configured transducers. As shown in FIG. 15B, transducers (for example, high frequency transducers or satellite speakers) 1540A, 1540B, 1540C, and 1540D can be attached to such interfaces by mating to form couplings that permit transmission of an audio signal to such transducers 1540A, 1540B, 1540C and 1540D or to mechanically secure the weight of wirelessly connected high frequency transducers while allowing for rotation. In some embodiments audio can be transmitted to such high frequency transducers via a first wireless connection while audio data for the low frequency transducer or audio processor can come from a distinct and different connection, even if the primary source of audio data is a single device. As shown in FIG. 15C, which provides a side view of a base unit 1510 and interfaces 1520B, 1520D, the base unit can be configured to be reversibly secured to a user via a flat surface 1565 that can be connected to shoulder straps 1570, such that the user can relocate the base unit to more than one location on the flat surface. It should be appreciated that in some embodiments such a base unit can be secured to the shoulder straps 1570 via the mating or engaging of a pair of interfaces. As shown, interfaces 1520E and 1520F can be coupled to shoulder straps or to bases that are affixed to the shoulder straps 1570, such that at least mechanical security is provided to high frequency transducers (or non-speaker devices) at other positions proximal to the ear of the user. FIG. 15D provides a top-down view of a backpack embodiment of the inventive concept, illustrating the relative positions of various components. It should be appreciated that provision for such a number of audio transducers and configuration of their orientation and output range supports the use of stereo and other audio systems as THX, Dolby Surround, and the like. In some embodiments the audio data can be provided throughout such a multi-transducer system by wired connections, wireless connections, or a mixture thereof.

Figure 16B:
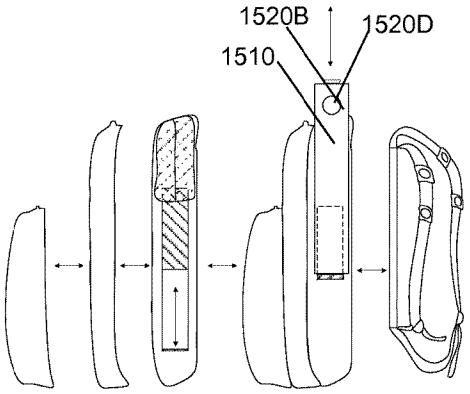
FIGS. 16A to 16D depict examples of an alternative wearable embodiments of the inventive concept.
Figure 16D:
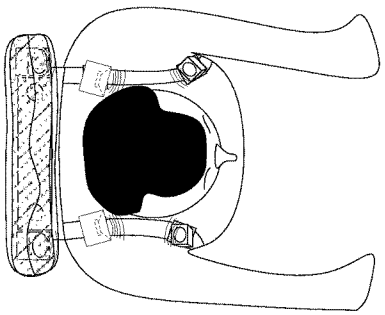
Figure 16A:
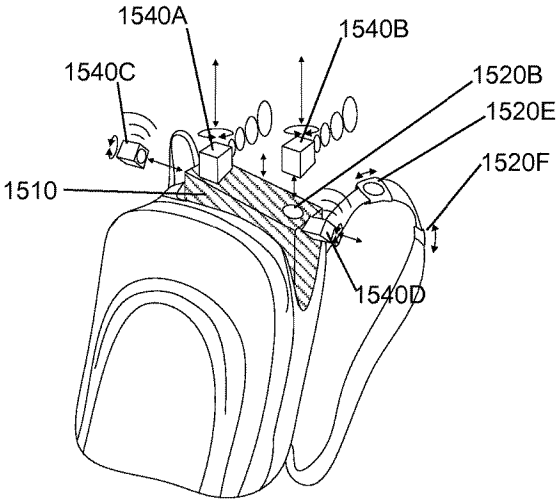
Figure 16C:
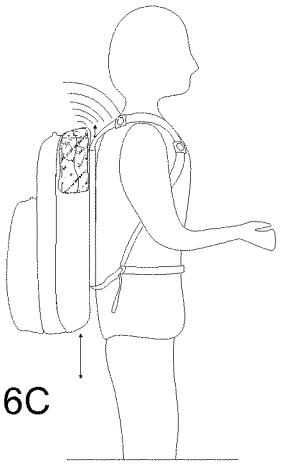

Another example of such embodiment is shown in FIGS. 16A 16B, 16C, and 16D, which share a number of components with the embodiment shown in FIG. 15. FIG. 16A depicts an external view showing of a backpack mounted embodiment that includes a low frequency transducer oriented towards the wearer's torso (not visible) and satellite speakers 1540A, 1540B, 1540C, 1540D that can be mounted to a mounting surface 1570. FIG. 16B shows a partially exploded view of such an implementation. FIG. 16C shows an external lateral view of a user wearing a backpack supporting such a system. FIG. 16D provides a top-down view of a user wearing a backpack supporting such a system.

In some embodiments the above described interfaces can include a USB or USB compatible connector that incorporate improved mechanical securing capabilities, such that an USB device attached through a coupling formed by mating such interfaces can have its own weight secured during rotation. In other embodiments such an improved USB device can include a wireless capability (such as WiFi or Bluetooth), thereby providing extensive customization capabilities to the user. In another embodiments an audio transducer of the inventive concept invention, a coupling can be configured to sense when the respective interfaces are mechanically coupled. In other embodiments, a base can be configured to sense if there is a USB device engaged via a coupling of the inventive concept and be programmed to alter its function based on such sensor data. For example, such a base unit could be configured to turn off a Bluetooth connection when a USB connection is made through such a coupling. In some other embodiments USB or similar protocols can be used to transmit audio data to multiple audio transducers such that impedance variation from multiple transducers connected in series or parallel is overcome.

In other embodiments of the inventive concept a portable audio system can be secured to a chair or similar seating device such that low frequency vibrations can be transmitted directly to a user and higher frequencies can be directed towards the ear of the user. In such embodiments the vertical position of the base unit relative to the chair can be adjusted such that the low frequency transmission best satisfies the user. In some embodiments a flexible holding structure is provided for this purpose that is reversibly attachable to a back support of such a chair or, alternatively, to a portion below the seat. In other embodiments a semi-rigid structure made of a malleable material that can adapt to protuberances of the back of a chair is provided for this purpose. In other embodiments a chair is provided that has an interface with the features described above such that a portable stereo system can be mechanically secured by the chair in a reversible manner. Such a chair be configured to support batteries that provide power to the portable audio system, such that the chair can be moved around without interference. In some embodiments the portable audio system can be rotated relative to the chair. Other non-speaker devices can be also reversibly secured and rotate relative to the back or bottom portion of the chair. It should be appreciated that such a chair is adapted to provide for a more realistic audio experience, particularly for computer gaming activities. In such embodiments one or more of the interfaces can be secured at positions of a chair, such as arms or headrest.

Figure 17B:
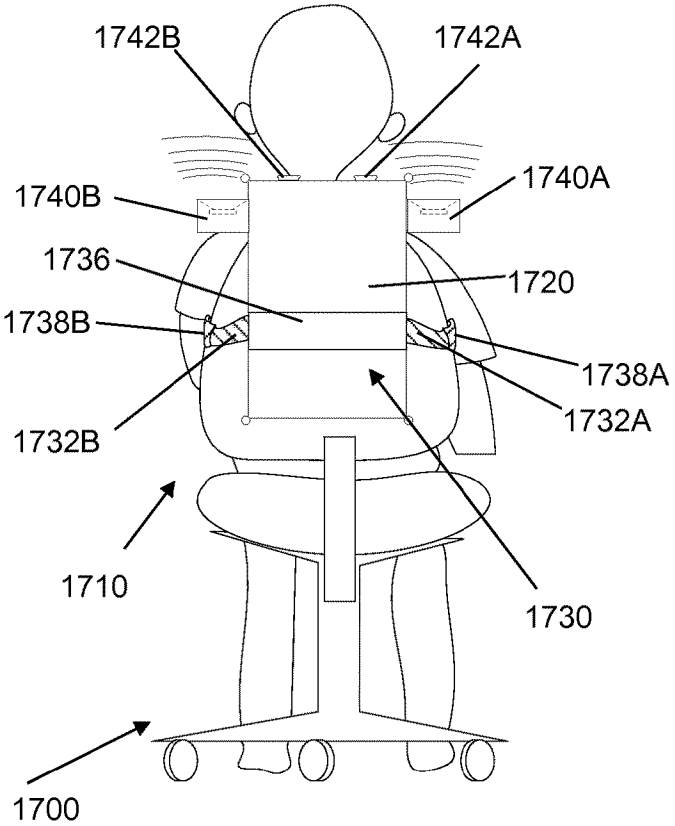
FIGS. 17A and 17B depict an embodiment of the inventive concept mounted on a chair.
Figure 17A:
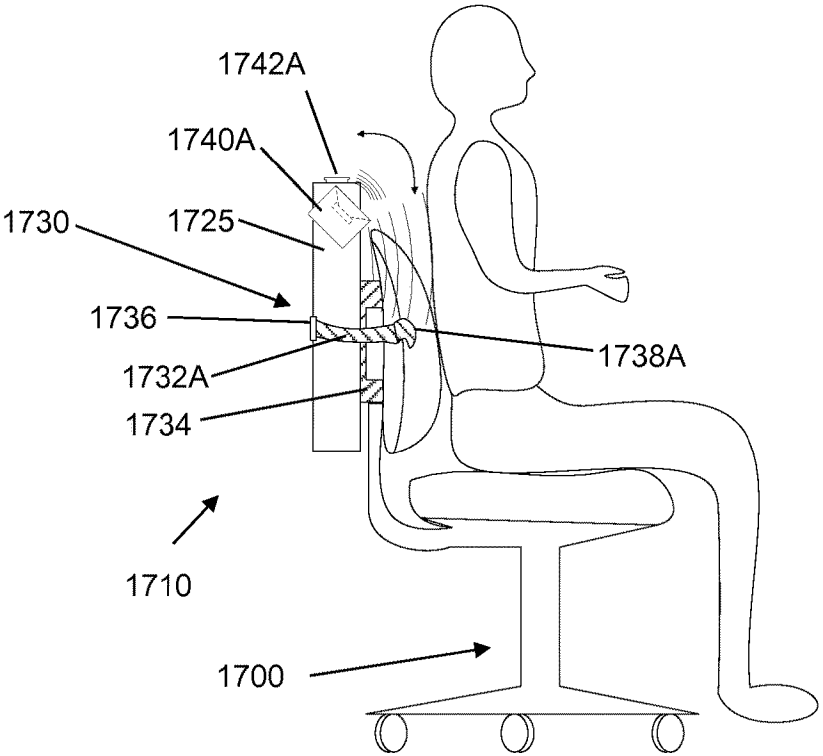

An example of such a system is depicted in FIGS. 17A and 17B. FIGS. 17A and 17B depict a side view and a back view, respectively, of a portable audio system 1710 of the inventive concept attached to an office chair 1700. The portable audio system includes a base unit 1720 secured to the back of the chair by a securing assembly 1730. An adapter 1734 for adjusting the base unit's position relative to the chair is interposed between the back of the chair and a base unit 1725. Force exerted by a securing structure 1736 can be used to hold the base unit 1725 under tension from a connected elastic band 1732A on one side that is connected to a grasping base 1738A and on the other side. The securing structure 1736 can be connected to an additional elastic band 1732B that is connected to a grasping base 1738B. The grasping bases 1738A and 1738B can secure to portions of the chair. In an alternative embodiment, the adapter is not part of the system. It should be appreciated that such embodiments are well suited for users that want to listen to audio, for example as part of a gaming experience, by providing highly directed high frequency audio towards the ear of the user while having vibrations directed towards the thorax (which is one of the most sensitive areas of the body to such vibrations). In another embodiment additional speakers can be provided to improve the user's perception at both locations of the body.

In other embodiments the high frequency transducer includes a flexible enclosure, for example EVA or materials with similar properties. Such a high frequency transducer can include one or more openings in the flexible enclosure configured to support interfaces of the inventive concept. In should be appreciated that embodiments of the inventive concept facilitate testing of audio transducers by exchanging them on one interface.

Another embodiment of the inventive concept is a method to provide for a user configurable audio transducer support system where the support can be instantaneously installed to the headrest independent of the audio transducer and the audio transducer can be removed from the headrest independent of the support. The method provides for exchangeable audio transducers and vertical adjustment of audio output in a vehicle having a headrest. Methods of the inventive concept include one or more of the steps of: (a) providing two or more interfaces (of the inventive concept described above) or one or two headrests of the inventive concept (having an interface of the inventive concept secured to the headrest or an interface of the inventive concept secured to a receptacle that is secured to the headrest); (b) providing a first speaker system (of the inventive concept described above, reversibly coupled to either one of the two or more interfaces); (c) installing the interfaces on one or more of a vehicle headrests or installing one or more headrests in a vehicle; (d) attaching the speaker system to either one of the interfaces; (e) connecting the system (for example, connecting the speaker system wirelessly to a portable audio source or connecting the interfaces to an audio source; (f) rotating the speaker system while secured to the headrest to establish a desirable vertical degree (for example, directing the speaker system output higher or lower depending on the ear level of a seated person; (g) detaching from the interface it was formerly attached to; and (h) securing to the other interface in other location in the vehicle and if desired adjust the audio output vertically. It should be appreciated that this description does not limit embodiments of the method to the order presented, and that such steps can be re-ordered as suits the needs of a user for a particular application. This method results in a vehicle where the user can configure the audio in instants as he desires.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. An entertainment system, comprising:

a housing having an audio processor configured to process an input audio data stream into a low frequency audio output stream and a middle to high frequency output stream, the housing having a low frequency audio transducer configured to receive the low frequency audio output stream to produce a low frequency audio output, the housing having at least two first interfaces distributed about the housing for releasably coupling respectively to a second interface of a middle to high frequency audio transducer configured to receive the middle to high frequency output stream and to broadcast a middle to high frequency audio output, whereby a user may select a location on the housing for the middle to high frequency audio transducer by selecting one of the first interfaces for coupling to the second interface of the middle to high frequency audio transducer and the user may rotate the middle to high frequency audio transducer with respect to the housing, and whereby the user may change the middle to high frequency audio transducer to a different location on the housing by selecting another of the first interfaces for coupling to the second interface of the middle to high frequency audio transducer.

2. The entertainment system of claim 1, further comprising a garment for holding the housing so the at least two first interfaces distributed about the housing are accessible with respect to the garment for releasably coupling respectively to the second interface of the middle to high frequency audio transducer.

3. The entertainment system of claim 1, wherein the first interface is configured to receive the middle to high frequency output stream from the audio processor, and wherein the second interface is configured to receive the middle to high frequency output stream from the first interface and to mate with the first interface to form a rotatable coupling.

4. The entertainment system of claim 3, wherein the rotatable coupling is positionable to direct the middle to high frequency audio transducer towards the user's head by rotation of the rotatable coupling.

5. A portable entertainment system having speakers that are interchangeable and rotatable for a user's enjoyment, comprising:

a portable case including a low frequency speaker with the portable case having at least two interfaces of a first type; and at least two middle to high frequency (MTHF) speakers with each MTHF speaker having an interface of a second type for releasable connection, respectively, to an interface of the first type, the releasable connection between an interface of the first type on the portable case and the interface of the second type on each of the at least two MTHF speakers being a rotatable connection so the MTHF speaker may be rotated with respect to the portable case; and each of the at least two MTFH speakers including, respectively, an interface of the first type for connection to an interface of the second type of another MTFH speaker, whereby a first MTHF speaker is rotatably connectable to the portable case, and a second MTHF speaker is rotatably connectable to the first MTHF speaker or to the portable case.

6. The portable entertainment system of claim 5, wherein the rotatable connection comprises rotation of up to 180 degrees.

7. The portable entertainment system of claim 5, wherein the rotatable connection comprises rotation of up to 360 degrees.

8. The portable entertainment system of claim 5, further comprising a strap to attach the portable case to a stationery object.

9. The portable entertainment system of claim 5, wherein the portable case is sized to fit within a backpack.

10. The portable entertainment system of claim 5, wherein the portable case is configured to lie on a surface.

11. The portable entertainment system of claim 5, further comprising a fan having an interface of the second type for connection to an interface of the first type associated with the portable case or with an MTHF speaker.

12. The portable entertainment system of claim 5, further comprising a light having an interface of the second type for connection to an interface of the first type associated with the portable case or with an MTHF speaker.

13. A portable, configurable audio system for use on the go or for stationery use, comprising:

a base unit having a generally rectangular box-like shape sized to fit within a backpack, to be carried by one or more straps, to be strapped to a chair, or to be set on a surface for stationery use, the base unit including a low frequency (LF) speaker, the base unit having two interfaces of a first type disposed, respectively, on opposite ends of one of the short sides of the base unit, and the base unit having two interfaces of the first type disposed, respectively, on respective ends of both of the long sides of the base unit close to the two interfaces on the short sides of the base unit;

middle to high frequency (MTHF) speakers with each MTHF speaker having an interface of a second type for releasable connection, respectively, to an interface of the first type, each of the at least two MTFH speakers including, respectively, an interface of the first type for connection to an interface of the second type of another MTFH speaker; and the releasable connection between the interface of the first type and the interfaces of the second type being a rotatable connection, whereby a first MTHF speaker is rotatably connectable via its interface of the second type to any of the interfaces of the first type on the base unit, and a second MTHF speaker is rotatably connectable via its interface of the second type to the first MTHF speaker or to the base unit, and whereby other MTFH speakers are rotatably connectable via respective interfaces of the second type to other interfaces of the first type on the base unit or even other MTFH speakers.

* * * * *